US012378027B2

(12) United States Patent
Johnson

(10) Patent No.: US 12,378,027 B2
(45) **Date of Patent: *Aug. 5, 2025**

(54) TAPE HEAD ASSIST ASSEMBLY

(71) Applicant: Pearson Packaging Systems, Spokane, WA (US)

(72) Inventor: Michael J. Johnson, Spokane, WA (US)

(73) Assignee: Pearson Packaging Systems, Spokane, WA (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/752,464

(22) Filed: Jun. 24, 2024

(65) Prior Publication Data

US 2024/0425214 A1 Dec. 26, 2024

Related U.S. Application Data

(63) Continuation of application No. 17/481,163, filed on Sep. 21, 2021, now Pat. No. 12,017,813.

(51) Int. Cl.

| | |
|---|---|
| ***B65B 51/06*** | (2006.01) |
| ***B65B 57/04*** | (2006.01) |
| ***B65B 61/06*** | (2006.01) |
| ***B65H 35/00*** | (2006.01) |

(52) U.S. Cl.

CPC ..... *B65B 51/067* (2013.01); *B65B 57/04* (2013.01); *B65B 61/06* (2013.01); *B65H 35/0013* (2013.01); *B65H 2402/54* (2013.01); *B65H 2701/1944* (2013.01)

(58) Field of Classification Search

None

See application file for complete search history.

(56) References Cited

U.S. PATENT DOCUMENTS

| | | | | |
|---|---|---|---|---|
| 12,017,813 | B2 * | 6/2024 | Johnson | B65B 61/06 |
| 2010/0175836 | A1 * | 7/2010 | Lam | B65H 35/0013 156/468 |
| 2012/0227905 | A1 * | 9/2012 | Menta | B65H 35/0013 156/538 |

(Continued)

OTHER PUBLICATIONS

Office Action for U.S. Appl. No. 17/481,163, mailed on Feb. 15, 2023, Michael J. Johnson, "Tape Head Assist Assembly", 7 pages.

(Continued)

*Primary Examiner* — Tanzim Imam

(74) *Attorney, Agent, or Firm* — Lee & Hayes, P.C.

(57) ABSTRACT

A tape head assembly—which tapes flaps of boxes on a conveyor—includes power-assist functionality to stretch a first spring used to power a trailing roller to press tape against a trailing case sidewall of a case. A force by the case moving on the conveyor acting upon a leading roller may provide some of the energy to stretch the first spring. However, a roller-assist air cylinder uses compressed air to assist or fully stretch the first spring. A knife assembly may be used to cut the tape applied to a case. A second spring may be stretched by the force of the moving case acting upon a knife arm. The second spring may be used later operate the knife blade. However, a knife-assist air cylinder uses compressed air to assist or fully stretch the second spring. Both assist assemblies may be turned off to operate the tape head in a conventional manner.

16 Claims, 36 Drawing Sheets

(56) References Cited

U.S. PATENT DOCUMENTS

| | | | | |
|---|---|---|---|---|
| 2013/0081758 | A1 | 4/2013 | Johnson | |
| 2019/0022967 | A1 | 1/2019 | Nakamura et al. | |
| 2019/0352120 | A1* | 11/2019 | Lam | B65H 35/0013 |
| 2019/0352121 | A1* | 11/2019 | Lam | B65H 35/0033 |
| 2021/0139177 | A1* | 5/2021 | Zhang | B65B 51/067 |
| 2022/0063854 | A1* | 3/2022 | Bern | B65B 57/08 |
| 2022/0135268 | A1* | 5/2022 | Menta | B65B 51/067 156/60 |
| 2023/0089892 | A1 | 3/2023 | Johnson | |

OTHER PUBLICATIONS

Office Action for U.S. Appl. No. 17/481,163, mailed on Sep. 22, 2023, Johnson, "Tape Head Assist Assembly", 9 pages.

* cited by examiner

TAPE HEAD ASSIST ASSEMBLY

RELATED APPLICATIONS

This application is a continuation of and claims priority to U.S. patent application Ser. No. 17/481,163, filed Sep. 21, 2021, titled "Tape Head Assist Assembly," the entirety of which is incorporated herein by reference.

BACKGROUND

Tape heads may be used to apply tape to the folded flaps of boxes or cases moving on a conveyor assembly. In an example, a leading roller of a tape head contacts a leading (vertically oriented) side of a case. The contact presses tape onto the side of the case, thereby holding the tape in place. As the case moves, the leading roller is pushed horizontally by the moving case. The leading roller also moves upwardly, pressing the tape against the case until the leading roller reaches the top of the side of the case and "turns the corner" and begins to press tape to seal together the top flaps of the case. Accordingly, the leading roller is moving along the top of the case, pressing the tape against the two top flaps, thereby sealing them together. As the case advances further, a trailing roller joins the leading roller, pressing the tape against the two flaps on the top of the case. As the case advances further, the case moves to a point wherein the leading roller is no longer in contact with the top of the case. As the case advances further, the trailing roller reaches the end of the top of the case, and "turns the corner" and begins to press tape down the side of the case. A knife cuts the tape, so that the end of the tape can be pressed onto the side of the case. The cut also provides a fresh end of tape that is hanging in position to contact the leading vertically-oriented side of the next case on the conveyor.

A spring is used to power aspects of the above system. When a case traveling on a conveyor contacts the leading roller, movement of the leading roller and connected linkages begins to stretch the spring. Thus, energy from the motion of the case is used to tension (typically, to stretch) the spring. The power within the spring is discharged when the trailing roller "turns the corner" and moves down the trailing side of the case, which is sometimes referred to as the "kick" by the trailing roller that seals tape to the trailing side of the case after the top flaps have been sealed. A second spring may be used to obtain power from the moving case, which is released to cut the tape with the knife as the case moves by the tape head.

Several problems are present with this very widely-used arrangement. A first problem is that the initial contact between the leading roller and the case may deform (e.g., dent) the case, particularly if it contains light product (e.g., potato chips). A second problem is that the leading and trailing rollers may not be able to properly apply tape to a dented location of the case. A third problem is that, unless sufficient energy is stored in the spring, the trailing roller may not "turn the corner" fast enough, and the trailing end of the tape may not be properly sealed to the trailing side of the case. Accordingly, deformed and/or improperly taped cases may result.

BRIEF DESCRIPTION OF THE DRAWINGS

The detailed description is described with reference to the accompanying figures. In the figures, the left-most digit(s) of a reference number identifies the figure in which the reference number first appears. The same numbers are used throughout the drawings to reference like features and components. Moreover, the figures are intended to illustrate general concepts, and not to indicate required and/or necessary elements.

FIG. 2 is an orthographic or side view of the example tape head, showing movement of a case approaching a leading roller.

FIG. 3 is an orthographic view showing the case contacting the leading roller.

FIG. 4 is an orthographic view showing the case wherein the leading and trailing rollers in contact with the top of the case.

FIG. 5 is an orthographic view showing the case wherein the trailing roller in contact with the top of the case.

FIG. 6 is an orthographic view showing the case wherein the trailing roller having turned the corner, and is now in contact with the trailing vertically-oriented side of the case.

FIG. 7 is an orthographic view showing the case wherein the trailing roller having pressed tape against the trailing side of the case and has just stopped applying pressure to the trailing vertically-oriented side of the case.

FIG. 8 is an orthographic view showing an example tape head with and showing the roller-assist air cylinder in a retracted position.

FIG. 9 is an orthographic view showing a case in contact with the leading roller and showing the roller-assist air cylinder in an extended position to assist extending the spring.

FIG. 10 is an orthographic view showing the leading and trailing rollers in contact the upper surface of the case and showing the roller-assist air cylinder in an extended position.

FIG. 11 is an orthographic view showing the trailing roller in contact the upper surface of the case and showing the roller-assist air cylinder in a retracted position.

FIG. 12 is an orthographic view showing the trailing roller having turned the corner and is pressing tape against the trailing side of the case using power from the roller spring that was at least partially obtained from the roller-assist air cylinder.

FIG. 13 is an orthographic view showing the case as the trailing roller, having pressed tape against the trailing vertically-oriented side of the case, has just lost contact with the case.

FIG. 15 is an orthographic view showing the leading roller turning the corner after having pressed tape against a leading side of the case and showing a knife arm coming into contact with a case.

FIG. 16 is an orthographic view showing the leading roller pushing tape against the top of the case and showing the knife arm almost parallel to the top surface of the case.

FIG. 17 is an orthographic view showing the case having past the leading roller, the trailing roller pushing tape against the top of the case, and showing the knife arm sliding near the edge of the top surface of the case, with the knife nearing a position at which the cut of the tape will be made.

FIG. 18 is an orthographic view showing knife arm having slid off the edge of the top surface of the case, and showing the knife in the position where the cut of the tape is made.

FIG. 19 is an orthographic view showing the case having past the end of the tape head, and the knife arm, leading roller and trailing roller all in their lowered positions associated with relaxed respective springs.

FIG. 20 is an orthographic view showing the case making initial contact with the leading roller and the knife-assist air cylinder in a retracted position.

FIG. 21 is an orthographic view showing the leading roller moving up the leading vertically-oriented side of the case, showing the knife-assist air cylinder in an extended position indicating that the knife spring has been stretched and the knife arm raised.

FIG. 22 is an orthographic view showing the trailing roller moving along the top of the case, the knife arm sliding on the top of the case, and the knife-assist air cylinder in the retracted position where it will not interfere with the knife spring as it moves the knife blade to cut the tape.

FIG. 23 is an orthographic view showing the trailing roller moving along the top of the case, the knife arm having slipped of the top of the case, and the knife and knife arm, powered by the spring, cutting the tape (tape not shown for clarity).

FIG. 24 is an orthographic view showing the trailing roller turning the corner to transition from pressing tape onto the top of the case to pressing tape onto the trailing side of the case.

FIG. 25 is an orthographic view showing the case moving away from the trailing roller, which has finished pressing tape onto the trailing side of the case.

FIG. 27 shows a perspective view of a case coming into contact with the leading roller.

FIG. 28 shows a perspective view of the leading roller pressing tape (not shown for clarity) to the leading vertically-oriented side of the case.

FIG. 29 shows a perspective view the leading roller and the trailing roller pressing tape (not shown) onto the top of the case.

FIG. 30 shows a perspective view of the trailing roller pressing tape (not shown) onto the trailing vertically-oriented side of the case.

FIG. 31 shows a perspective view a case coming into contact with the leading roller, and shows the roller-assist air cylinder extending to assist in stretching the spring.

FIG. 32 shows a perspective view of the leading roller pressing tape onto the top of the case, and shows the roller-assist air cylinder still in the extended position.

FIG. 33 shows a perspective view of the leading roller and the trailing roller pressing tape onto the top of the case, and shows the roller-assist air cylinder having moved into the retract position.

FIG. 34 shows a perspective view of the trailing roller pressing tape against the trailing vertically-oriented side of the case using power from the stretched roller spring, at least some of which was obtained from the roller-assist air cylinder.

DETAILED DESCRIPTION

Overview

Figure 1:
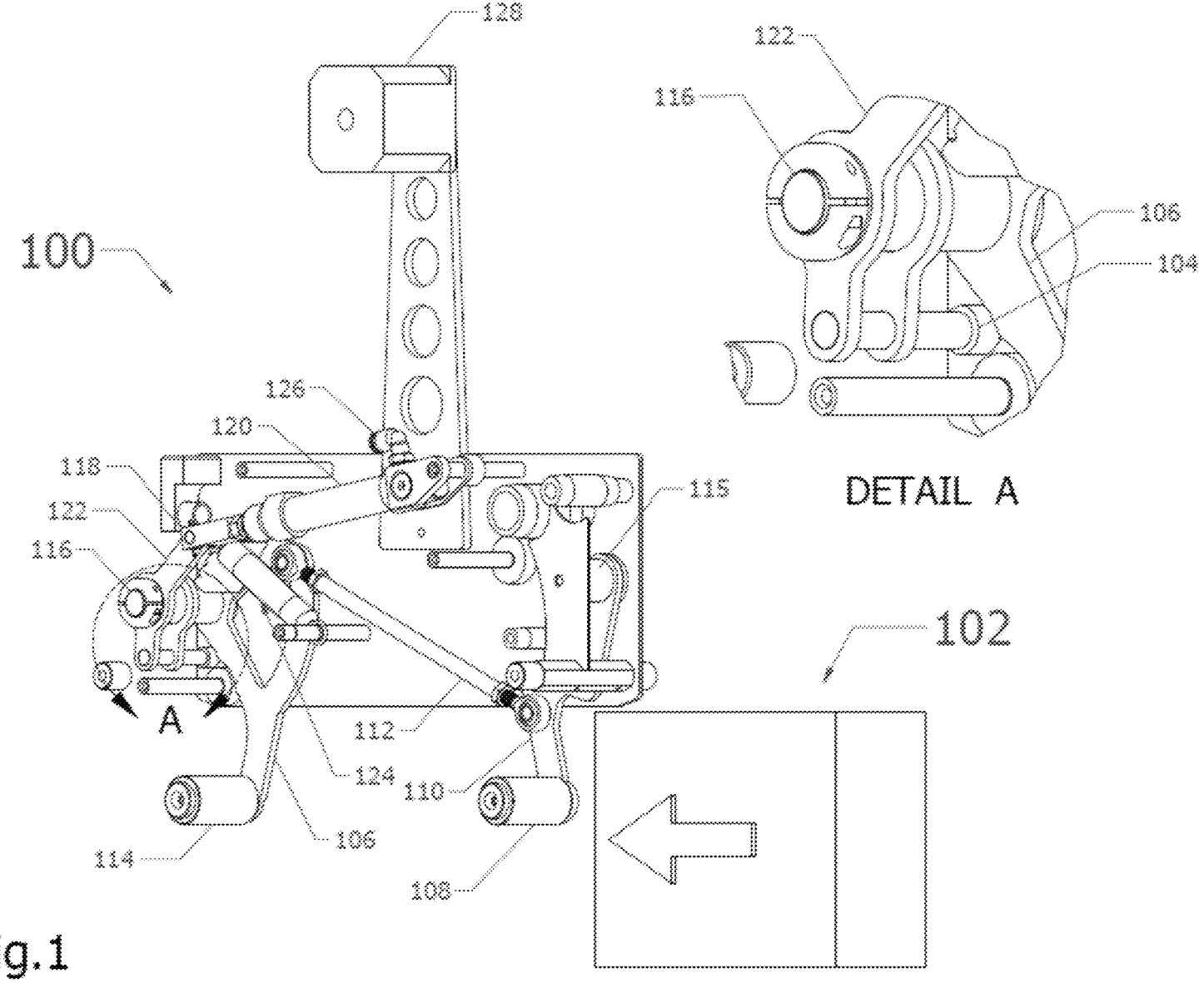
FIG. 1 is a perspective view of an example tape head showing aspects of an example roller-assist assembly, but with a tape-cutting (e.g., knife or blade) assembly and a knife-assist assembly removed for clarity.

The disclosure describes techniques for constructing and operating a tape head assist assembly. In prior technologies, a leading roller of a tape head may deform or damage the cardboard of cases moving down a conveyor. Additionally, tape may be poorly applied to the deformed areas. And still further, the tape on the trailing side of the case may not be adequately sealed against the case due to inadequate power in the spring. Additional problems are present in known tape-cutting (e.g., knife) assemblies.

Thus, known technologies tension springs (in roller assemblies and knife assemblies) by using a force imparted by the moving case. The innovation uses compressed air cylinder(s) to provide as least some of the power obtained and stored by the one or more springs of the tape head.

With regard to the roller assembly (used to press tape against the case), the leading roller is pushed by the case moving on the conveyor. This action stretches a first spring (a roller assembly spring) and provides power to extend the trailing roller to press the tape against the trailing side of the conveyor as it moves away from the tape head. In an example of the innovation, a roller-assist air cylinder is used to provide some or all of the energy needed stretch the first spring.

With regard to the knife assembly (used to cut the tape after it has been applied to the case), the knife arm is pushed by the case moving on the conveyor. This action stretches a second spring (a knife assembly spring) and provides power to move the knife to make the cut. In an example of the innovation, a knife-assist air cylinder is used to provide some or all of the energy needed stretch the second spring.

Overview Examples

An example tape assist includes components added to a conventional tape head that may or may not be activated. If the typical problems of deformed cases and poorly applied tape are not seen, then the tape assist may be turned off and the tape head functions in a "conventional" mode of operation. However, in many cases the power-assist machinery (roller-assist and/or knife-assist) and associated control systems are turned on.

In an example, an air cylinder is used to provide power to stretch a roller-powering spring. While a moving case is applying a force to the leading roller—to thereby stretch a roller-powering spring—an air-powered roller-assist cylinder also applies a force to extend the roller-powering spring. Because the air-powered roller-assist air cylinder is also stretching the roller-powering spring, the force by the case required to move the leading roller is much less than it would have been. In an example, the air-powered roller-assist cylinder may provide 90% of the force needed to extend the spring, while the leading roller (moved by the advancing case) may provide 10% of the power. The air-powered roller-assist cylinder may be extended over approximately a same period time that force from the case against the leading roller stretches the spring. Alternatively, the air-powered roller-assist cylinder may fully extend the roller spring, e.g., upon first contact by a case of the leading roller. When the spring is fully stretched and at least one roller is on the top of the case (to prevent the spring from prematurely contracting), the air-powered roller-assist cylinder may be retracted and/or disengaged. In an example, when a source of compressed air is turned off, a spring within the air cylinder retracts the air cylinder, getting the air cylinder and roller-assist arm linkage out of the way (e.g., out of the way of the spring arm extension shaft), before the spring contracts. As the trailing roller moves off the top of the case, the spring contracts, releasing power that causes the trailing roller to press the end of the tape (which was recently cut) onto the trailing sidewall of the case.

Similarly, an air cylinder is used to provide some of the power to stretch a knife-powering spring. While a moving case is applying a force to a knife arm—to thereby stretch a knife-powering spring—an air-powered knife-assist cylinder also applies a force to extend the knife-powering spring. Because the air-powered knife-assist cylinder is also stretching the knife-powering spring, the force required by the case to move the knife arm is much less than it would have been. In an example, the air-powered knife-assist cylinder may provide 90% of the force needed to extend the spring, while the knife arm (moved by the advancing case) may provide 10% of the power. The air-powered knife-assist cylinder may be extended over approximately a same period time that force from the case against the knife arm stretches the knife-powering spring. Alternatively, the air-powered knife-assist cylinder may fully extend the knife spring, e.g., upon first contact by a case of the knife arm. After the knife arm is in contract with the top of the case and before the knife is released to be pulled by the spring to make the cut, the air-powered knife-assist cylinder may be retracted and/or disengaged. Once retracted and/or disengaged, power from the spring will not be wasted in an action to retract and/or disengage the air-powered knife-assist cylinder. When a length of tape sufficient to seal the trailing sidewall of the case has been obtained from a roll of tape, the knife-powering spring contracts, releasing power that moves the knife to cut the tape, which is then pressed to the trailing sidewall of the case by the trailing roller.

Example Systems and Techniques

FIG. 1 shows an example tape head 100 having an example roller-assist assembly. In the view shown, the tape-cutting (e.g., knife) assembly and a knife-assist assembly have been removed for clarity. A case (e.g., a cardboard box full of product, such as bags or cans of food, etc.) is moving on a conveyor (not shown) in the direction of the arrow, i.e., approaching the leading roller 108. The example tape head 100 includes a spool 128 to which a roll of tape may be attached.

A leading roller 108 is the roller that contacts a leading vertical side of the case before the trailing roller 114 contacts a trailing vertical side of the case. That is, the leading vertical side of the case is "leading" because it makes contact with the case before the trailing roller makes contact with the case. The leading roller 108 is supported by a leading roller arm 110, which pivots and supports the leading roller as the leading roller presses tape against the leading vertical side of the case, and presses tape against the two flaps on the top of the case. A linkage 112 connects the leading roller arm 110 to the trailing roller arm 106, which supports the trailing roller 114. Accordingly, contact by the case with the leading roller 108 pivots the leading roller arm 110 about leading roller arm pivot shaft 115, and also moves the linkage 112. The moving linkage 112 pivots the trailing roller arm 106 about trailing roller arm pivot shaft 116. Movement of the trailing roller arm 106 moves the trailing roller 114. Thus, the leading roller 108 and trailing roller 114 move in concert. In an example of their movement, the rollers are both shown in a lowered position in FIG. 1 and are both shown in an elevated position in FIG. 4.

A roller spring 124 is held in a fixed location at the first end and is attached to the trailing roller arm 106 at the second end. As the leading roller 108 and the trailing roller 114 move from the lowered position of FIG. 1 to the elevated position of FIG. 4 the spring is stretched. In an alternative to the spring, power may otherwise be stored in an alternative device. As will be seen in later figures, as the spring releases power and returns to the relaxed position, it moves the rollers from the elevated position of FIG. 4 to the lowered position of FIG. 1.

An example roller-assist assembly is also shown in FIG. 1. In the example, the roller-assist assembly may include the roller-assist air cylinder 120, the roller-assist air connector 126, the roller-assist arm linkage 118 (and similar feature 218 of FIGS. 26-34), the roller-assist contact arm 122, the roller-assist contact bumper 104, and/or other devices.

A roller-assist air cylinder 120 connected to roller-assist air connection 126 provides energy to stretch (e.g., tension) the roller spring 124. The power stored in the spring is either partly or fully obtained from roller-assist air cylinder. In some implementations, movement of the case 102 against the leading roller 108 may provide some of the energy used to stretch the roller spring 124. By adjusting the air pressure to the roller-assist air cylinder 120, the percentage of the load carried by the roller-assist air cylinder 120 can be adjusted. In an example, approximately 80% of the power in the fully stretched roller spring 124 may have come from the roller-assist air cylinder 120. However, the amount of assist provided by the roller-assist assembly may be adjusted. In example, the assist may be increased (e.g., to 90%) if the product in the case 102 is light in weight (e.g., a case full of bags of potato chips). In contrast, the assist may be lessened (although there may be no motivation to do so) if the case 102 is heavier (e.g., a case full of cans of beans). Accordingly, the level of assisted may be based at least in part on one or more of: weight of the cases to be sealed; density of the cases to be sealed; speed of the cases moving on the conveyor; nature of the material used to make the cases (e.g., cardboard thickness, etc.); etc.

Extension of the shaft within the air cylinder 120 advances roller-assist arm linkage 118. Movement of the roller-assist arm linkage 118 causes roller-assist contact arm 122 to rotate about trailing roller arm pivot shaft 116. Rotation of the roller-assist contact arm 122 causes roller-assist contact bumper 104 to push and thereby rotate the trailing roller arm 106 about shaft 116. Rotation of the trailing roller arm 106 stretches roller spring 124. Note that the trailing roller arm 106 is also urged to rotate by the linkage 112 in response to movement of the case 102 against the leading roller 108.

FIGS. 2-7 show an example method and techniques of operation of the tape head 100 with the roller-assist assembly in a disengaged or disabled mode. In the example of the disengaged mode, the roller-assist air cylinder 120 is held in a retracted position during operation.

Figure 2:
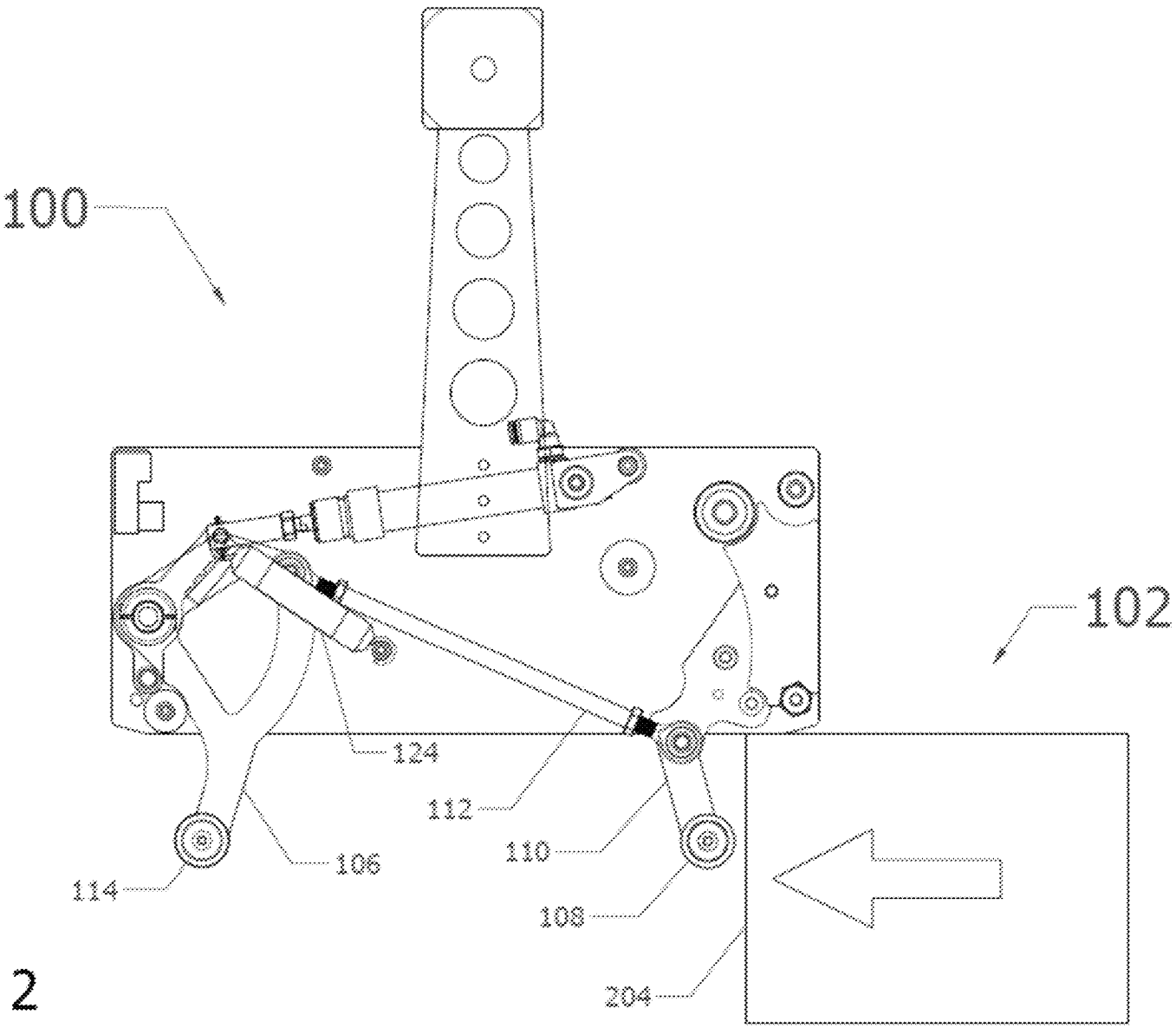
FIGS. 2-7 show operation of the tape head with the roller-assist assembly in a disengaged mode.

At FIG. 2, a leading vertically-oriented side 204 of a case 102 is approaching the leading roller 108. The leading roller 108 and the trailing roller 114 are in a lowered position, wherein they are in the path of the moving case 102. The leading roller arm 110 is connected by linkage 112 to the trailing roller arm 106. The roller spring 124 is in a relaxed state, storing no power.

Figure 3:
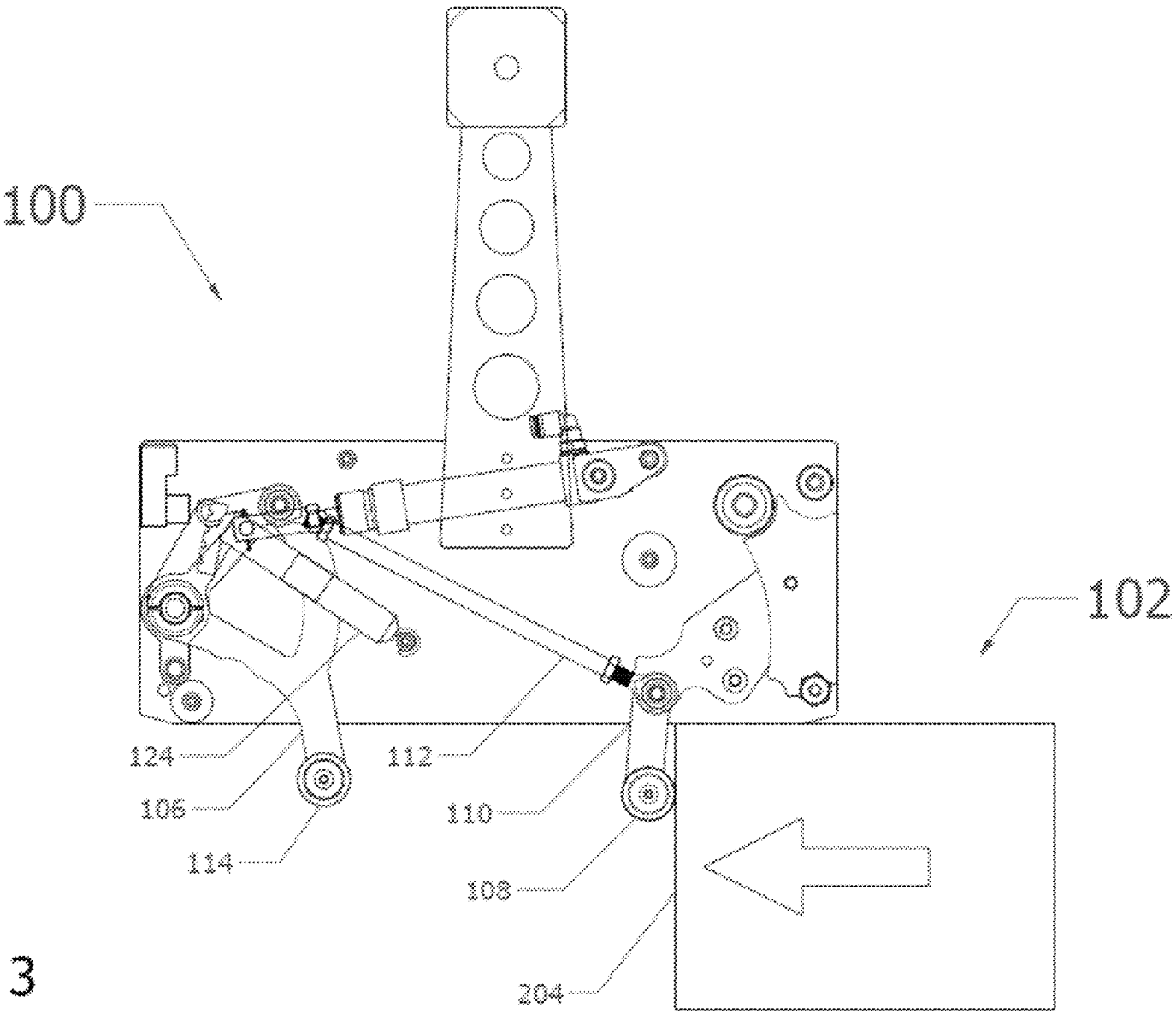

At FIG. 3, the leading vertically-oriented side 204 of the case 102 has contacted the leading roller. Accordingly, the leading roller 108 is pressing adhesive tape (not shown) against the leading vertically-oriented side 204. As the case moves to the left, the leading roller will move up the leading vertically-oriented side 204. Upon reaching the top of the leading vertically-oriented side 204, the leading roller will "turn the corner" and begin to press tape against the two adjacent flaps of the top of the case, thereby sealing the top of the case in a closed configuration. As the leading roller 108 moves up the leading vertically-oriented side 204 of the case 102, the trailing roller will also move upwardly, due to the linkage 112 and corresponding movement of the trailing roller arm 106. Also, as the leading roller 108 moves up the leading vertically-oriented side 204 of the case 102, the roller spring 124 is stretched.

Figure 4:
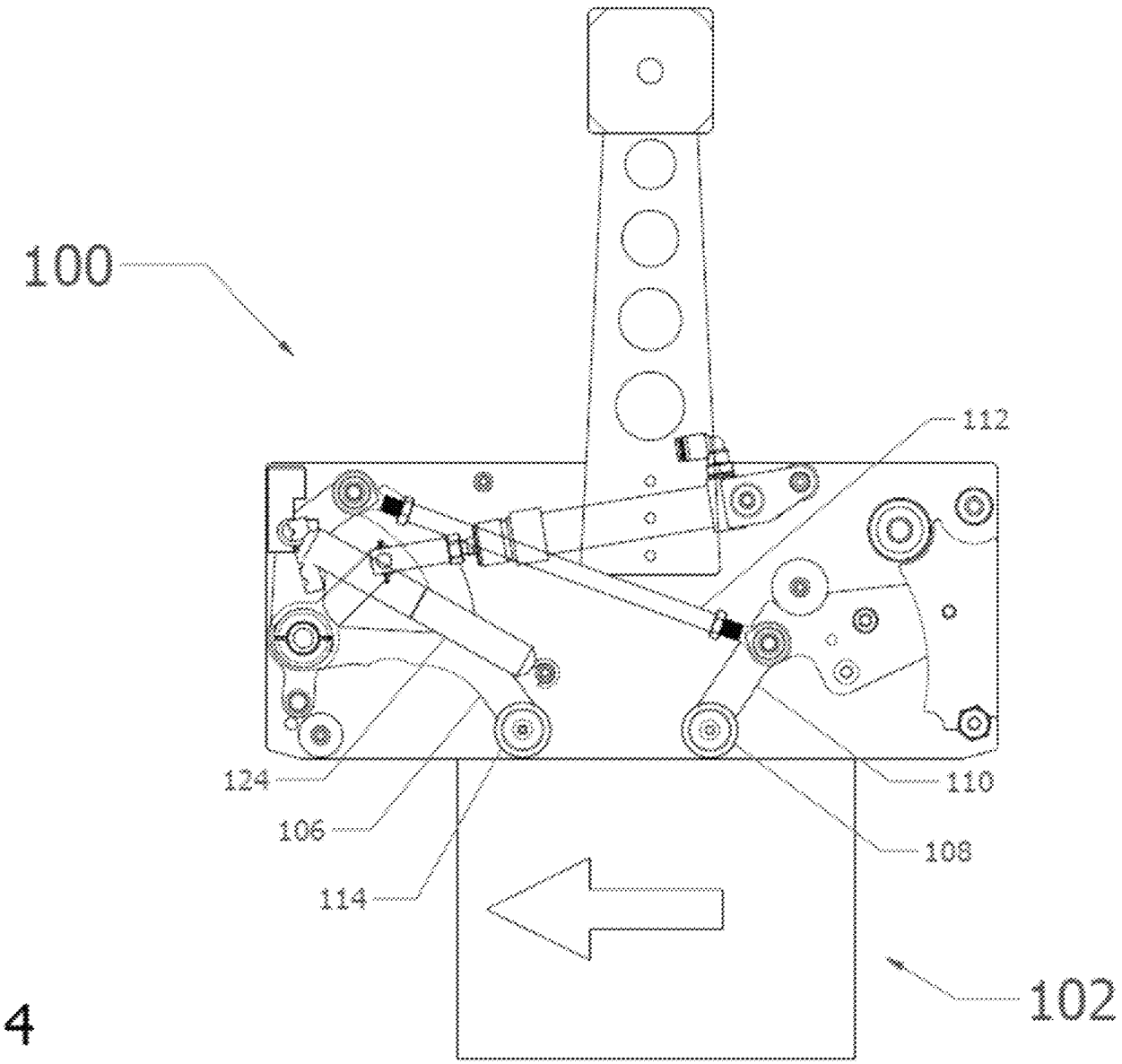

At FIG. 4, the leading roller 108 continues to move along the top surface of the case 102, pressing the tape against the two flaps, thereby sealing them together. The trailing roller 114 has joined the leading roller, and also presses tape against the two upper flaps. A comparison of FIGS. 2 through 4 show movement of the leading roller 108 and the trailing roller 114 from the lowered position of FIG. 2 toward the elevated position shown in FIG. 4. As the rollers move from the lowered position to the elevated position the roller spring 124 is stretched (i.e., power is stored in the spring). In later figures, as the rollers move from the elevated position to the lowered position, they are urged to do so by power released by the spring.

Figure 5:
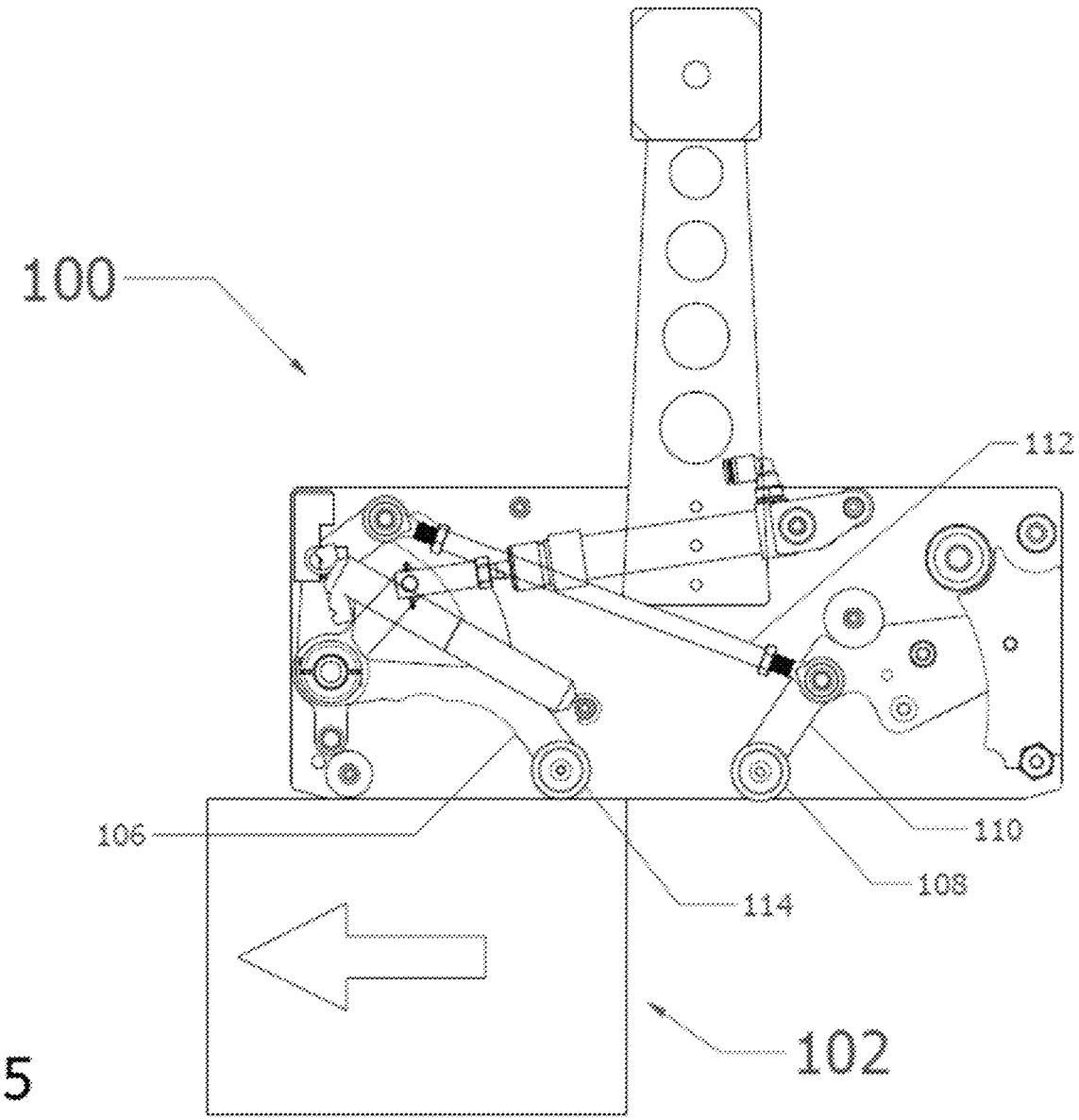

At FIG. 5, the case 102 has advanced far enough to the left that the leading roller 108 is no longer touching the top of the case 102. However, the leading roller 108 and the leading roller arm 110 is connected to the trailing roller 114 and trailing roller arm 106 by linkage 112, which prevents the leading roller from moving downward. The trailing roller 114 continues to press tape to join two flaps on the top of the case 102, as the case moves to the left while the tape head 100 stays in a fixed location.

Figure 6:
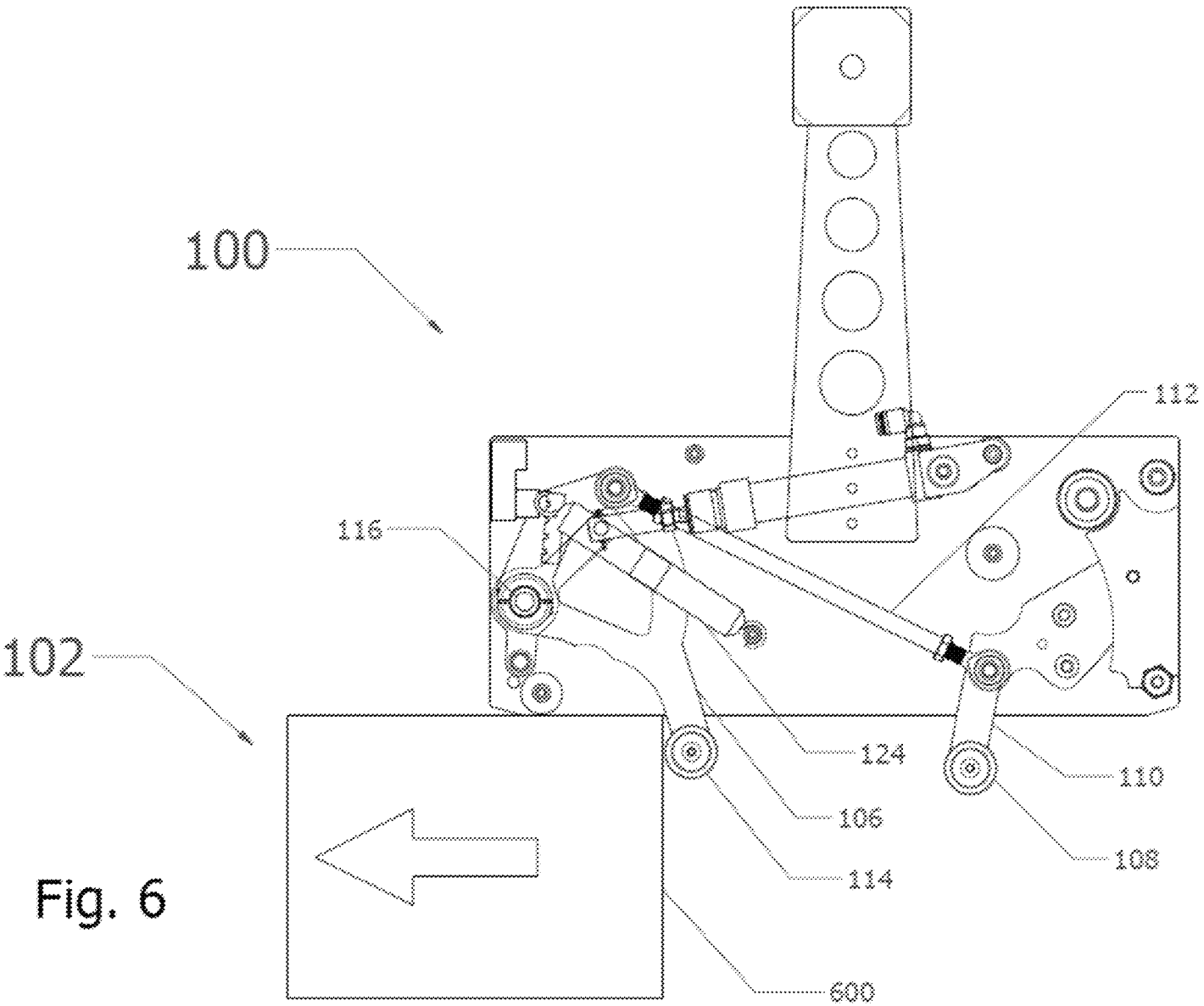

At FIG. 6, the case 102 has advanced far enough to the left that the trailing roller 114 is no longer touching the top of the case 102. The trailing roller has "turned the corner" and is shown to be pressing tape to the trailing vertically-oriented side 600. As the case 102 advances to the left, the trailing roller will turn about pivot point 116 under the power of the spring 124. Thus, the stretched and/or tensioned spring 124 contracts as it pulls the roller arm 106 about the pivot 116, thereby causing the trailing roller 114 to press tape on the trailing vertically-oriented side 600 of the case 102 as the case moves away from the tape head 100.

Figure 7:
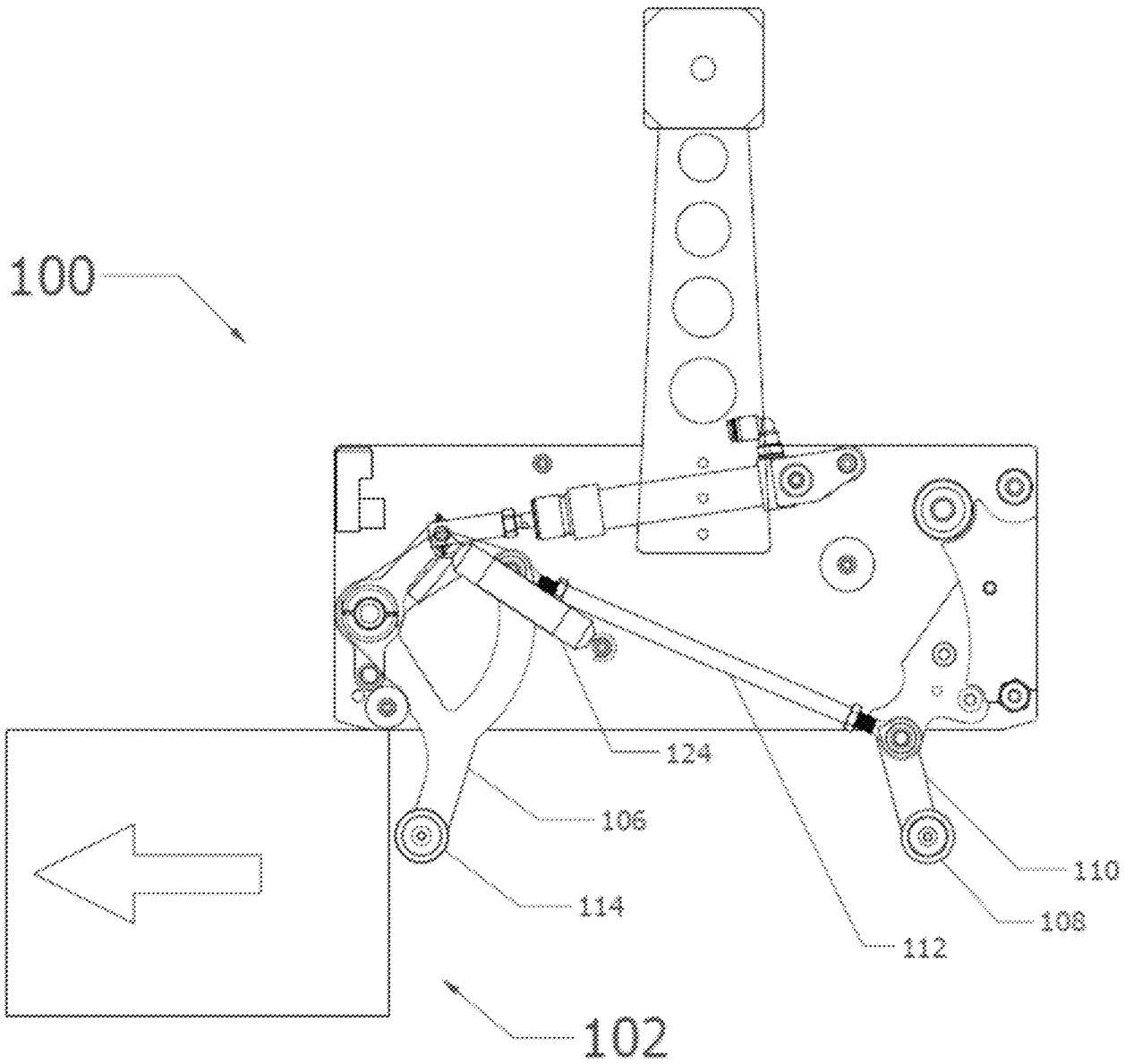

At FIG. 7, the case 102 has advanced far enough to the left that the trailing roller 114 is no longer touching the top of the case 102. The roller spring 124 is fully relaxed (e.g., the spring is no longer stretched). The leading roller 108 and the trailing roller 114 are in the lowered position. A comparison of FIGS. 4 through 7 show movement of the leading roller 108 and the trailing roller 114 from the elevated position of FIG. 4 toward the lowered position shown in FIG. 7. As the rollers move from the elevated position to the lowered position, the roller spring 124 is relaxed (i.e., power is released by the spring).

FIGS. 8-13 show example operation of the tape head with the roller-assist assembly in an engaged mode. In the example, a roller-assist air cylinder 120 provides energy to assist movement of the leading roller to stretch and/or tension the roller spring 124. Without the roller-assist air cylinder 120, the spring would be tensioned using power obtained from the case 102 moving the leading roller 108. Because the roller-assist air cylinder 120 provides a force that assists to tension the roller spring 124, the leading roller 108 provides much less resistance to the case 102 as it pushes against the leading roller. This reduces or prevents damage and/or deformation of the case, results in smoother application of tape to flatter case surfaces, and may allow cases to be moved more quickly through the tape head area of a conveyor assembly (e.g., because there is less concern for case damage).

The roller-assist assembly may include the roller-assist air cylinder 120, the roller-assist air cylinder air connector 126, the roller-assist arm linkage 118, the roller-assist contact arm 122, the roller-assist contact bumper 104, and other components as indicated by any particular implementation. The roller-assist assembly may also include a control assembly, which may include mechanical, electrical, and/or software-based processor-executed components.

Figure 8:
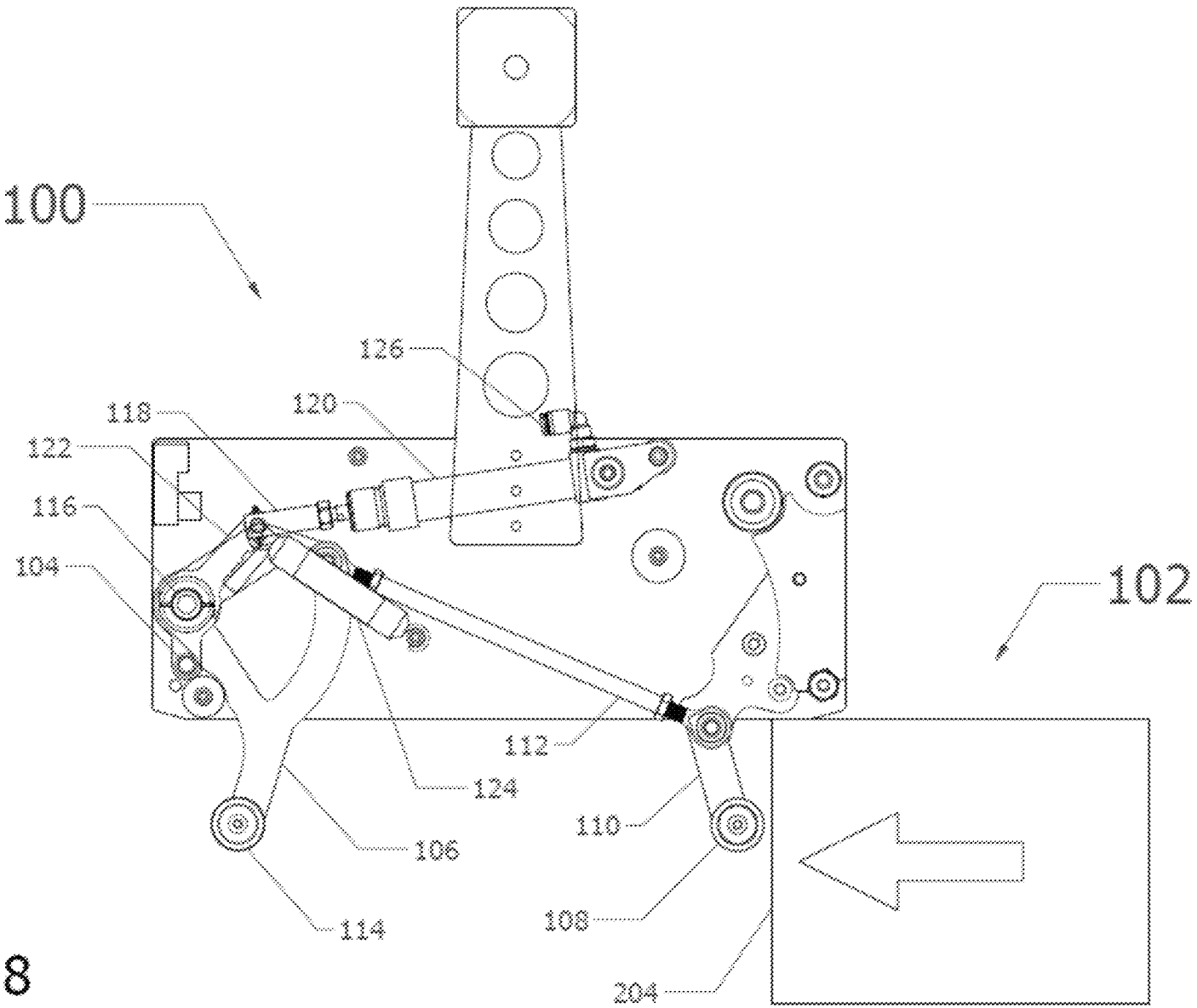
FIGS. 8-13 show example operation of the tape head with the roller-assist assembly in an engaged mode.

At FIG. 8, the case 102 is approaching the leading roller 108. The leading roller and the trailing roller 114 are both in the lowered position, indicating that the roller spring 124 is in a relaxed state (typically retracted and not stretched) that does not contain power. The roller-assist air cylinder 120 is in the retracted position.

Figure 9:
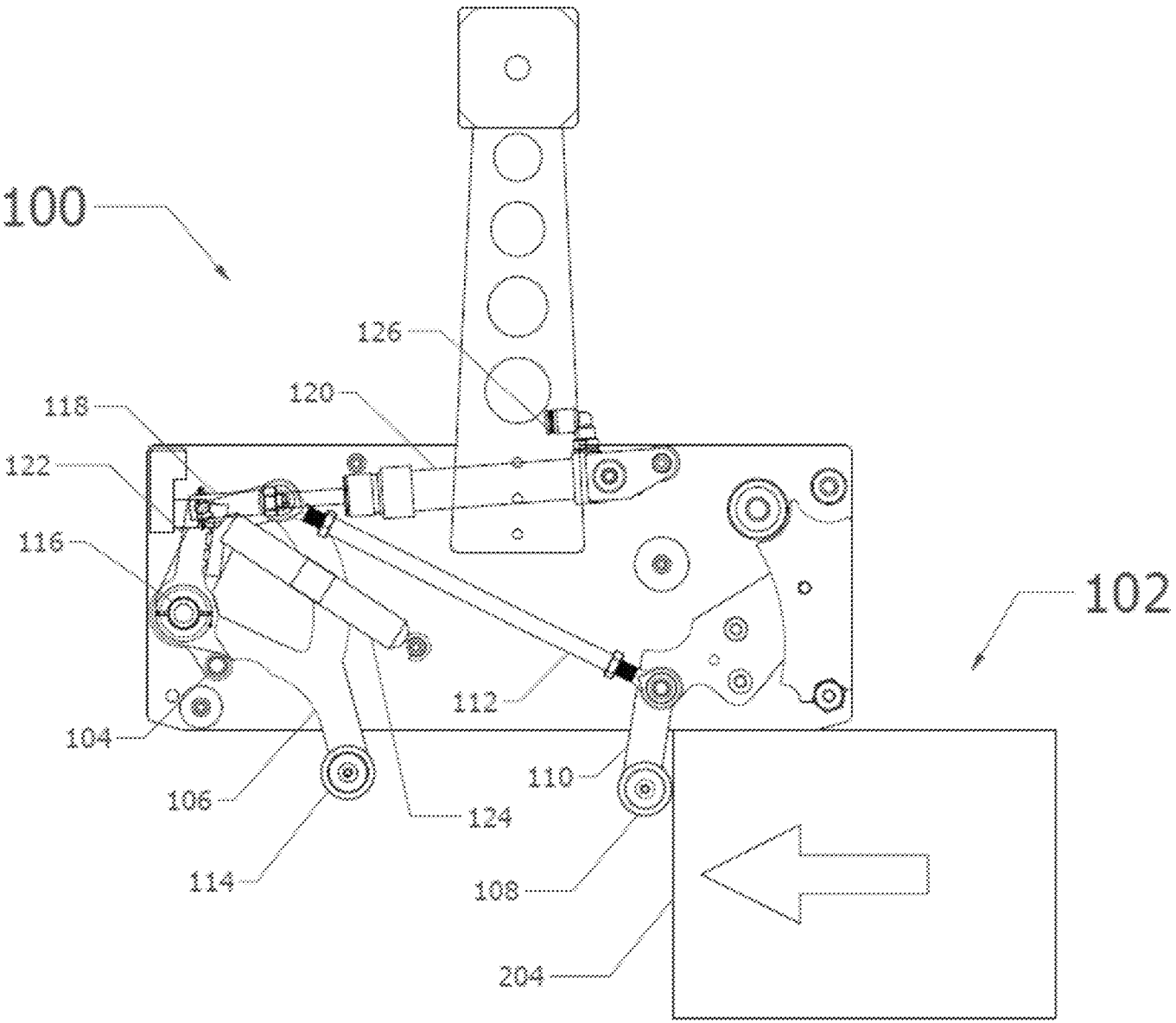

At FIG. 9, the leading vertically-oriented side 204 of the case 102 has contacted the leading roller 108. As the leading roller 108 moves, the leading roller arm 110 and linkage 112 move in response, and begin to stretch the roller spring 124.

A control assembly and/or control system applies compressed air to the roller-assist air cylinder 120. The control assembly may be controlled by timers, sensors, a mix of both, etc. The control assembly turns on and off compress air to the roller-assist air cylinder 120, thereby controlling when the cylinder is providing energy to stretch the roller spring 124. In an example, sensors may be positioned to detect the location of the case, or the location of the leading roller 108, leading roller arm 110, or another component. In additional examples, a timer may receive data (e.g., when the case 102 is a particular distance from the leading roller) and apply compressed air at the conclusion of the timed period. This may allow a sensor to be more conveniently located.

Upon a signal from the control assembly, compressed air is applied to the roller-assist air cylinder 120, which advances the roller-assist arm linkage 118, and advances the roller-assist contact arm 122 (better seen in FIG. 1). Rotation about the trailing roller arm pivot shaft 116 causes the roller-assist contact bumper 104 to push on the trailing roller arm 106, thereby stretching roller spring 124.

In an example, the energy provided by the roller-assist air cylinder 120 is almost enough (e.g., 90%) to overcome resistance of the roller spring 124 to stretch. The additional energy provided by the advancing case 102 and transmitted through the leading roller 108, the leading roller arm 110 and the linkage 112 is enough to stretch the roller spring 124. However, the roller-assist air cylinder may be selected and/or pressurized to provide any desired assist, from 1 to 100% of the energy needed to overcome resistance of the roller spring 124 at all stages of its extension.

Figure 10:
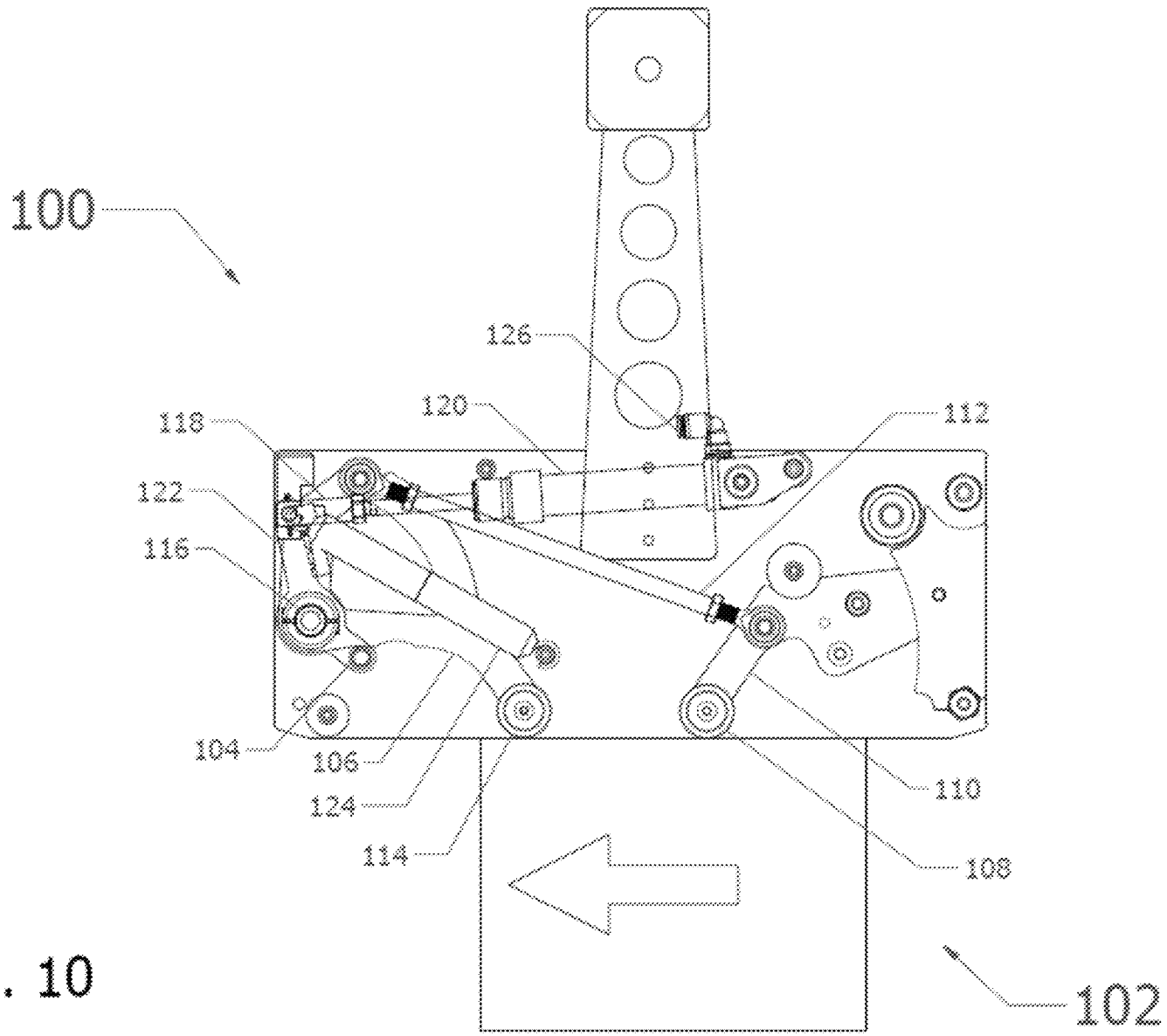

At FIG. 10, the roller-assist air cylinder 120 is extended, thereby extending or stretching the roller spring 124. The extension of the roller spring 124 began with contact of the case and leading roller, i.e., immediately after the scene of FIG. 8. At FIG. 8 the leading roller 108 and trailing roller 114 are in the lowered position. By FIG. 9, they are partially elevated, and in FIG. 10 the leading roller 108 and trailing roller 114 are fully elevated. In the fully elevated position, the roller-assist air cylinder 120 is fully extended. The linkage 112 is also fully extended. Accordingly, the roller spring 124 is fully extended.

Figure 11:
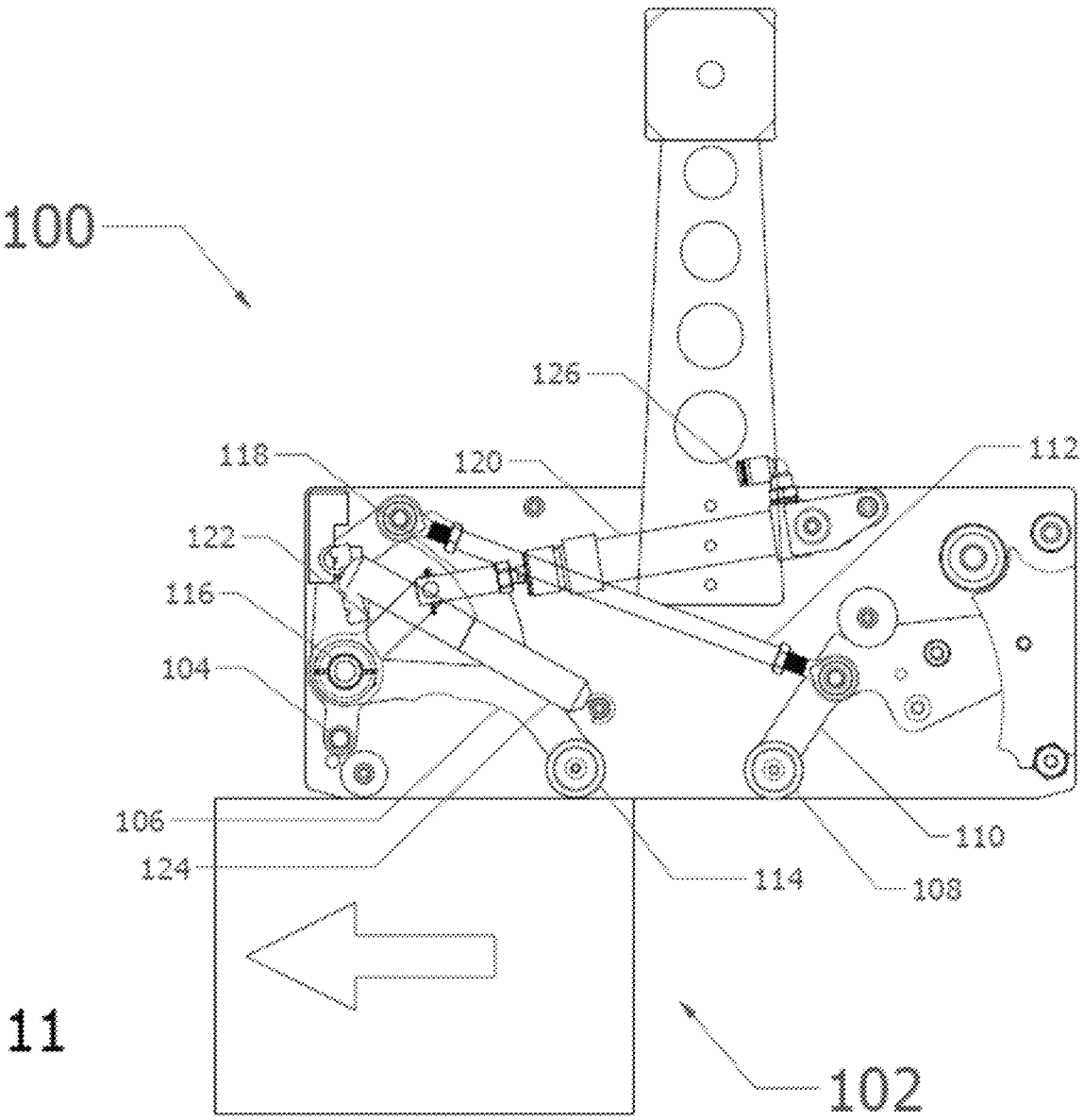

At FIG. 11, the trailing roller 114 continues to press tape against the two flaps on the top of the case 102. Accordingly, the leading roller 108 and trailing roller 114, which move in unison due to their connection by the linkage 112, are both still in the elevated position and the roller spring 124 is fully stretched.

In the conditions of either FIG. 10 or FIG. 11, the control system may disengage the compressed supplied to the roller-assist air cylinder 120. The spring will not contract because the trailing roller 114 is still in contact with the top of the case 102. With the compressed air disengaged, a spring within the roller-assist air cylinder 120 may retract the roller-assist arm linkage 118. Retraction of the roller-assist arm linkage 118 prevents loss of power stored in the spring as the spring contracts. That is, by getting the roller-assist air cylinder 120 out of the way, when the spring contracts it will not have to flush air from the cylinder and/or overcome any friction associated with moving the roller-assist arm linkage 118 and roller-assist contact arm 122.

Figure 12:
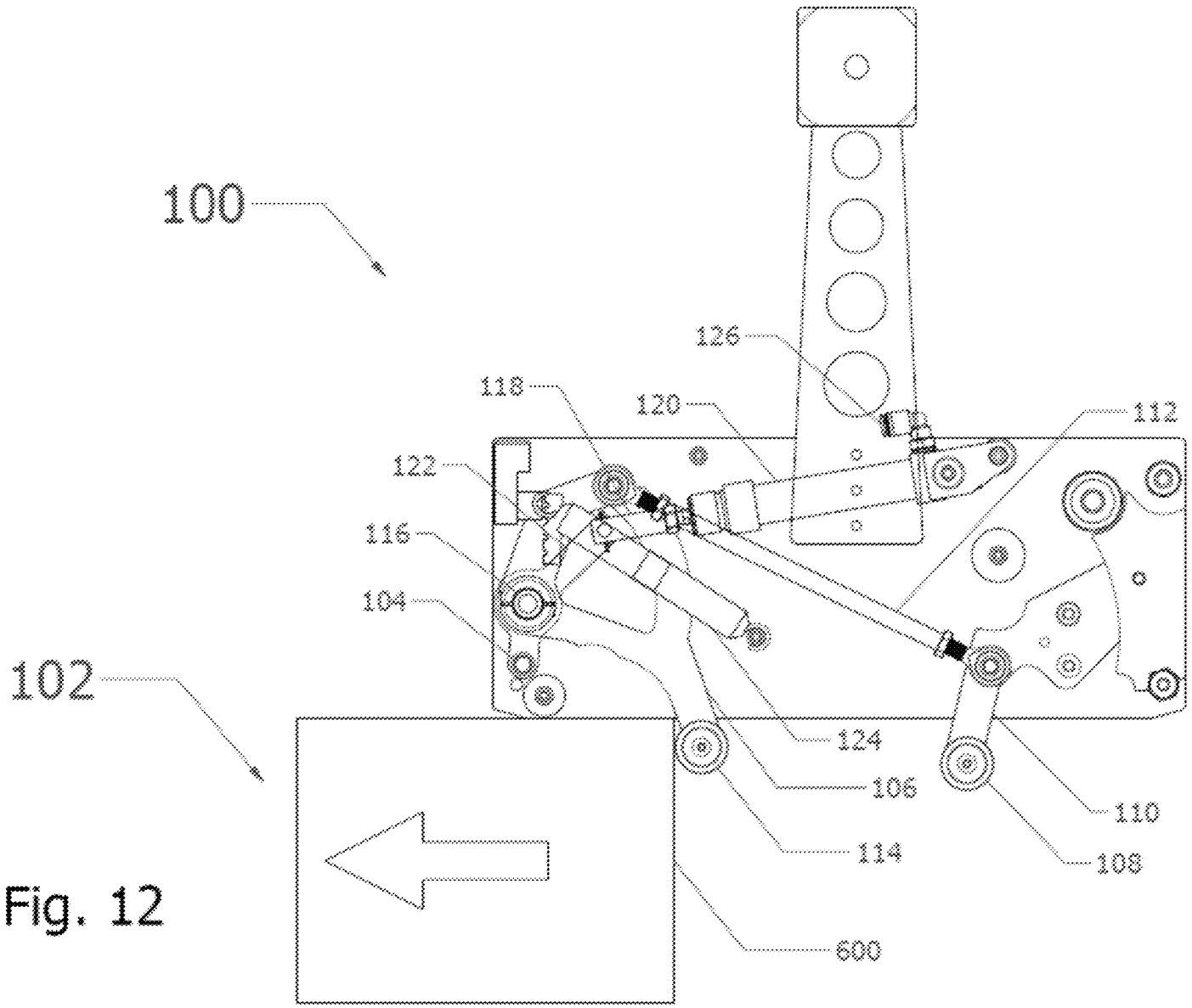

At FIG. 12, the case 102 has advanced to the point where the trailing roller 114 has turned the corner, and has begun to apply pressure to the end portion of the tape and to thereby secure the tape end to the trailing vertically-oriented side 600 of the case. Accordingly, FIG. 12 is an intermediate view, between elevated position of the leading roller 108 and trailing roller 114 (seen in FIG. 11) and the lowered position of the rollers (seen in FIG. 13). As the rollers transition from the elevated position to the lowered position power is released by the roller spring 124. The released power allows the trailing roller 114 to move both forwardly (to stay with the case as it moves forward) and downwardly (to continue pressing the end of the tape against the trailing vertically-oriented side 600.

Figure 13:
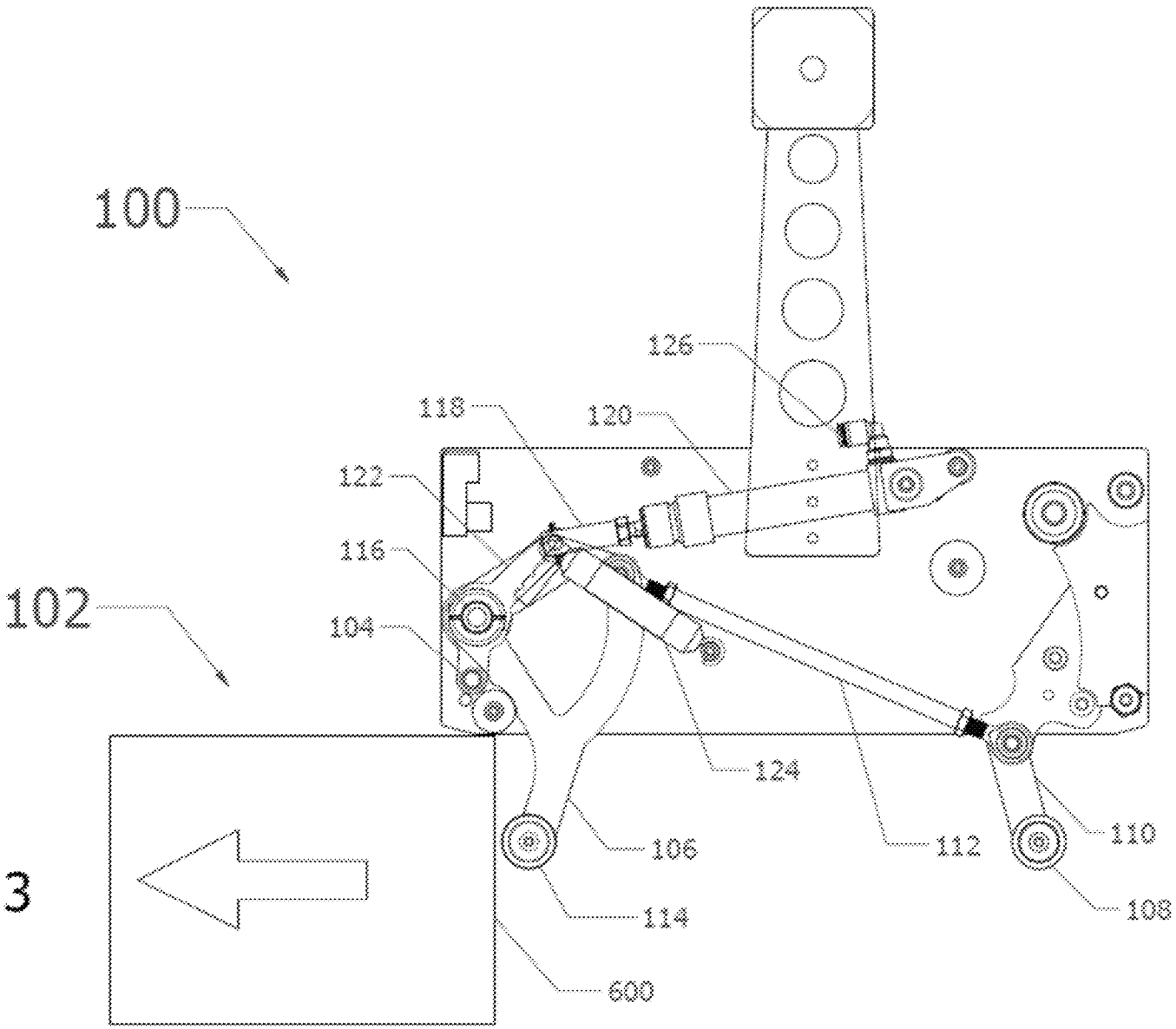

At FIG. 13, the trailing roller 114 has pressed the end of the tape (not shown for clarity) to the trailing vertically-oriented side 600 of the case 102. At this point, the tape head 100 is in position for a second case to arrive on the conveyor.

Figure 14:
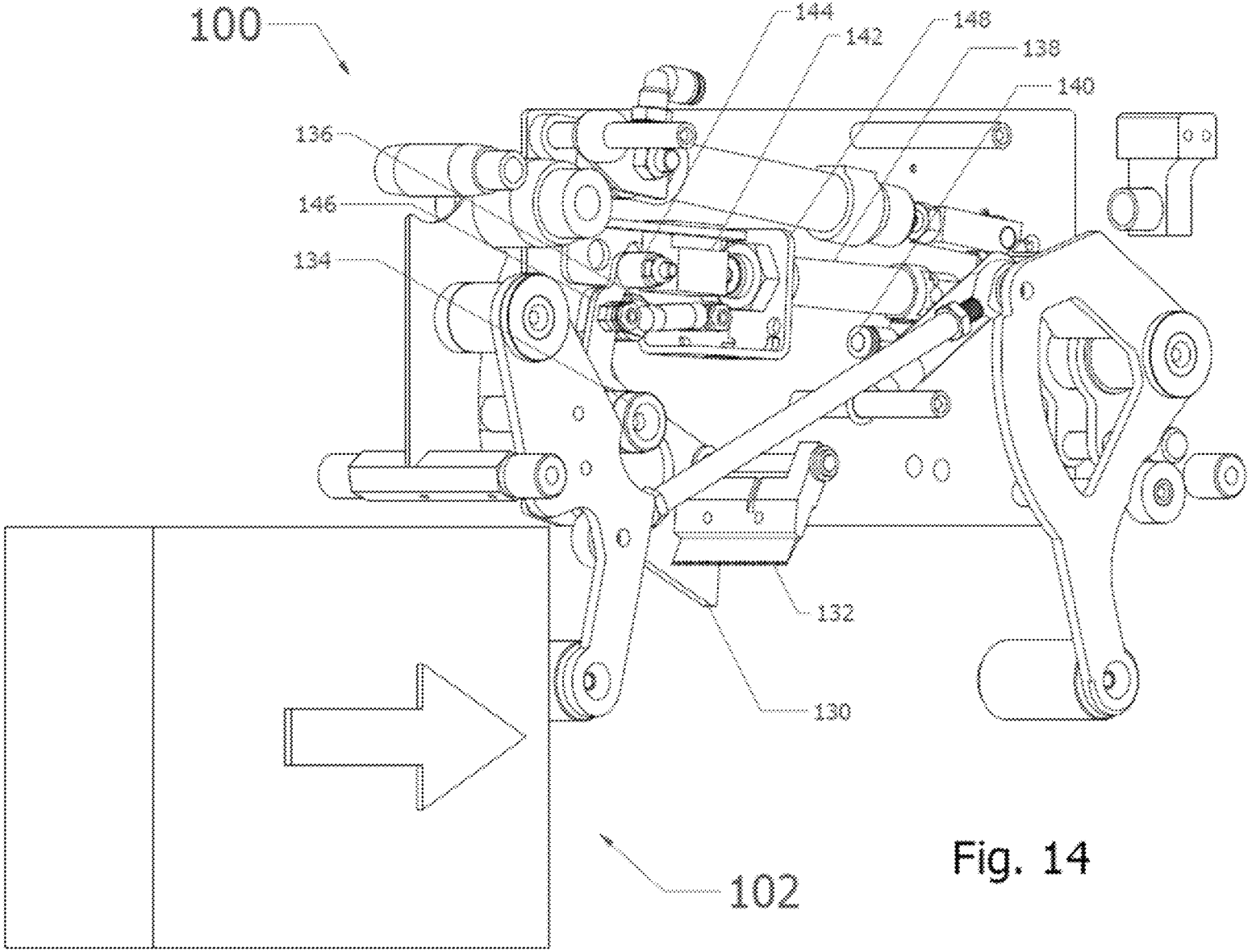
FIG. 14 is a perspective view showing the tape-cutting assembly (e.g., a knife assembly) and the tape-cutting assist-assembly (e.g., a knife-assist assembly).

FIG. 14 shows a view of the tape head 100 with both the roller-assist assembly and the knife-assist assembly visible. A knife arm 130 is in a lowered position, and will be contacted by the case 102 as it advances to the right. Movement of the knife arm 130 moves the knife arm extension 146 about the knife arm pivot 134, which stretches the knife spring 136. Accordingly, as the case 102 advances the knife spring 136 will stretch. The power in the knife spring 136 will be used to move the knife blade 132 after the case has past the knife blade. Movement of the knife blade 132 will cut the tape, and the cut end of the tape will be pressed against a trailing vertically-oriented sidewall of the case 102. With the knife-assist assembly turned off, all of the power in the stretched knife spring 136 will have been obtained from movement of the case 102 against the knife arm 130.

A knife-assist air cylinder 138 is mounted on a knife-assist cylinder mount 148. The knife-assist air cylinder 138 is configured to apply a force directed to stretching the knife spring 136, and to thereby reduce the force required by the case 102 to move the knife arm 130. In an example, 80% to 100% of the force required to stretch the spring come from the knife-assist air cylinder 138 and the remaining required force is obtained by the knife arm 130 from the movement of the case 102.

When the knife-assist air cylinder 138 is connected to compressed air (e.g., through the knife-assist cylinder air connection 140 and operation of a control system), the knife-assist push-block 142 is extended. The extension causes the knife-assist push-block 142 to contact the push-block roller 144. Pressure on the push-block roller 144 tends to stretch the knife spring 136, thereby reducing the resistance of the knife arm 130 to the advancing case 102.

FIGS. 15-19 show example operation of a tape head with a knife-assist assembly for the knife in a disengaged mode.

Figure 15:
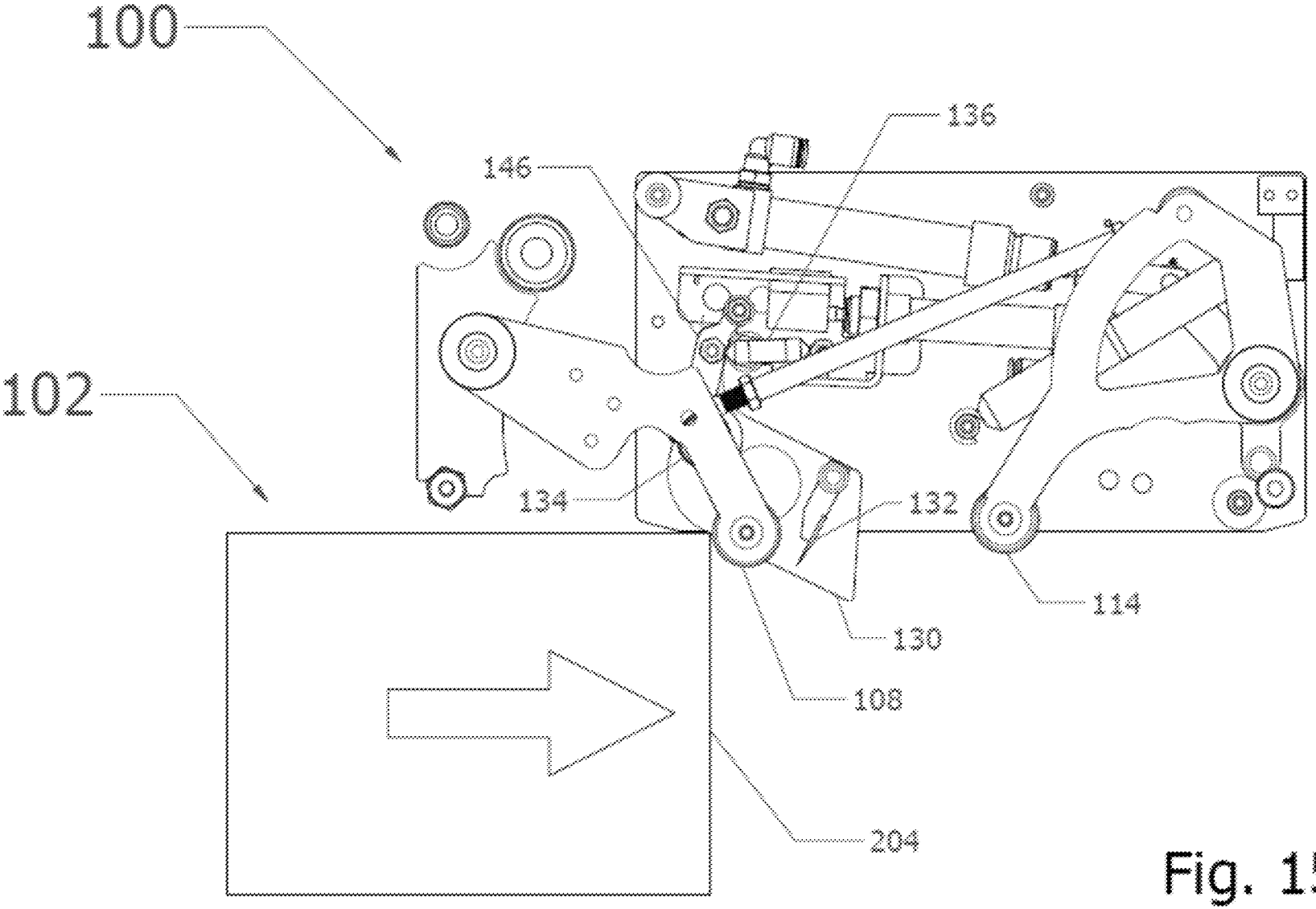
FIGS. 15-19 show example operation of a tape head with a knife-assist assembly for the knife in a disengaged mode, e.g., with the knife-assist air cylinder in the retracted position.

At FIG. 15, the leading roller 108 is turning the corner after having pressed tape against a leading vertically-oriented side 204 of the case 102. Accordingly, the leading and trailing rollers have moved upward from the lowered position and are almost to the elevated position. Once in the elevated position, the roller spring will be fully tensioned. The knife arm 130 has come into contact with the case. The knife blade 132 is attached to, and moving with, the knife arm 130. In the view of FIG. 15, the knife spring 136 has not yet been tensioned (e.g., stretched).

The knife arm 130 has come into contact with the case 102. Accordingly, as the case advances, the knife arm 130 will pivot about the knife arm pivot 134. Movement of the knife arm 130 rotates the knife arm extension 146 about the pivot 134. Movement of the knife arm extension 146 stretches the knife spring 136.

Figure 16:
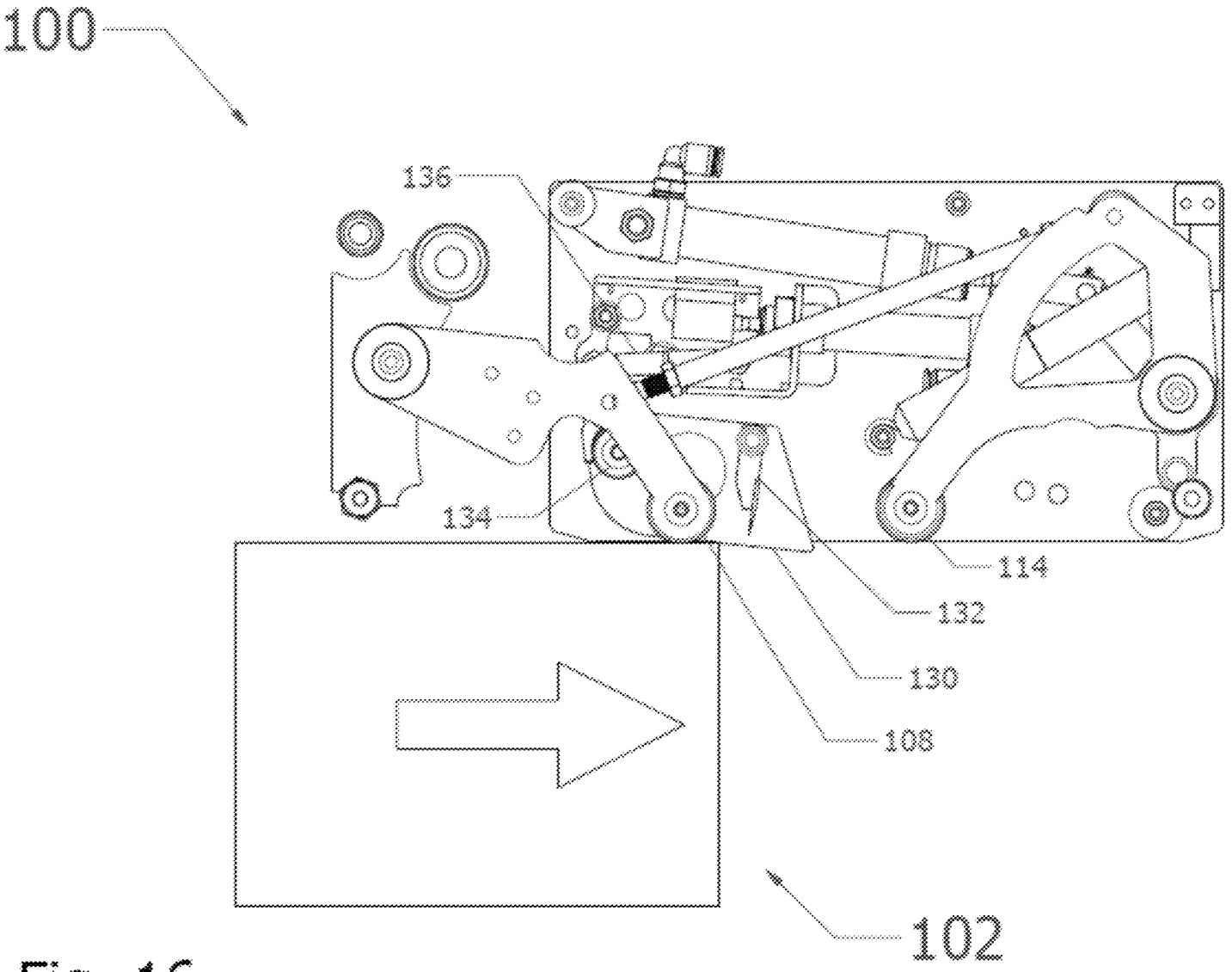

At FIG. 16, the leading roller 108 is pushing tape against the top of the case 102 and the trailing roller 114 is fully elevated (due to its connection to the leading roller). The knife arm 130 has been pushed by the case, and has rotated about knife arm pivot 134 so that the knife arm is almost fully on the top surface of the case. The knife blade 132 is attached to the knife arm 130. The knife spring 136 has almost fully stretched by the rotation of the knife arm 130 and the knife arm extension 146 about the knife arm pivot 134.

Figure 17:
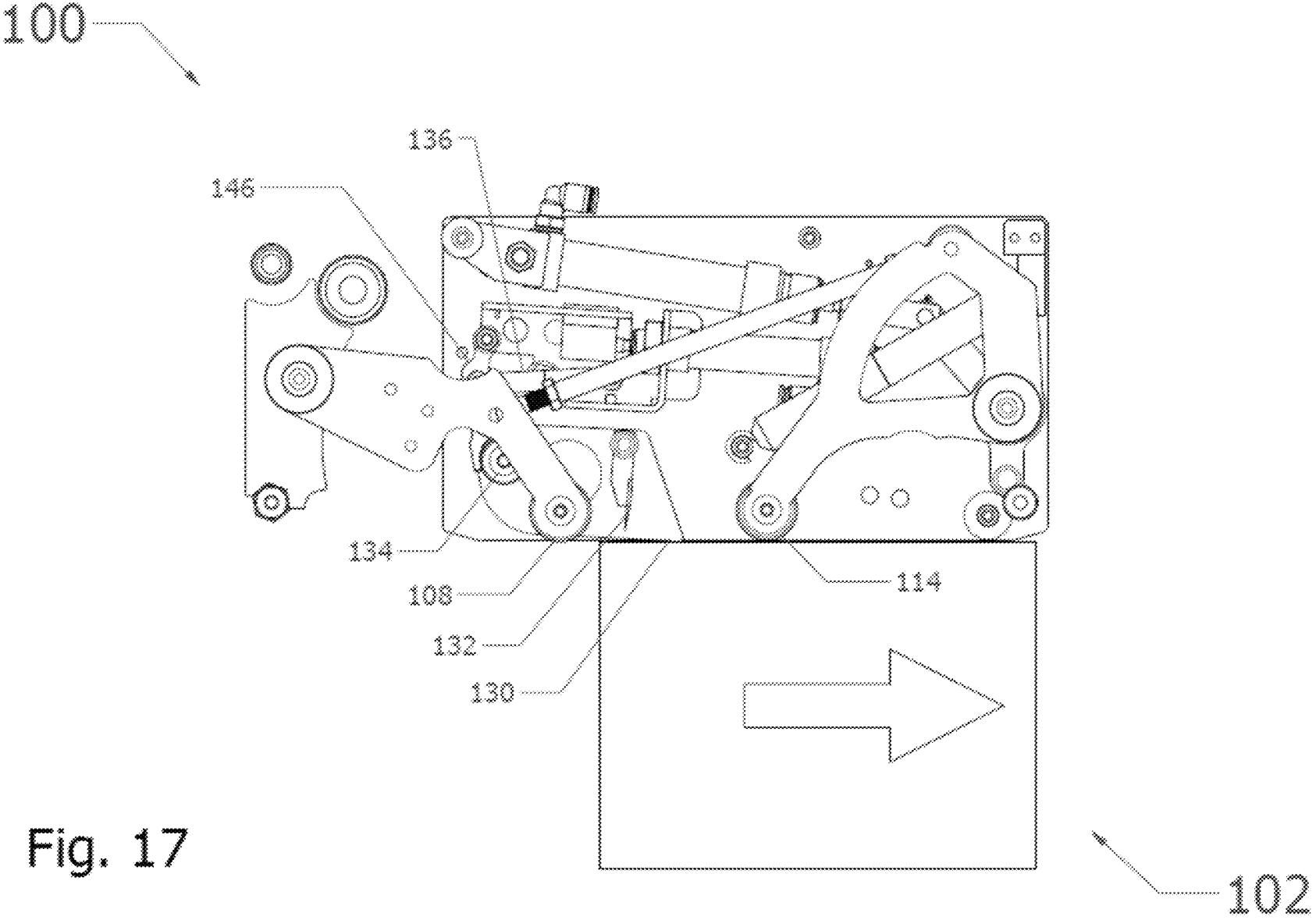

FIG. 17 shows the case 102 having past the leading roller 108 and shows the trailing roller 114 pushing tape against the top of the case. The knife arm 130 is sliding on the top of the case, and is nearing the edge of the top surface of the case. Because the knife arm 130 is fully elevated (i.e., fully above the case), the knife spring 136 is fully stretched. The knife blade 132 is nearing a position at which the cut of the tape will be made.

Figure 18:
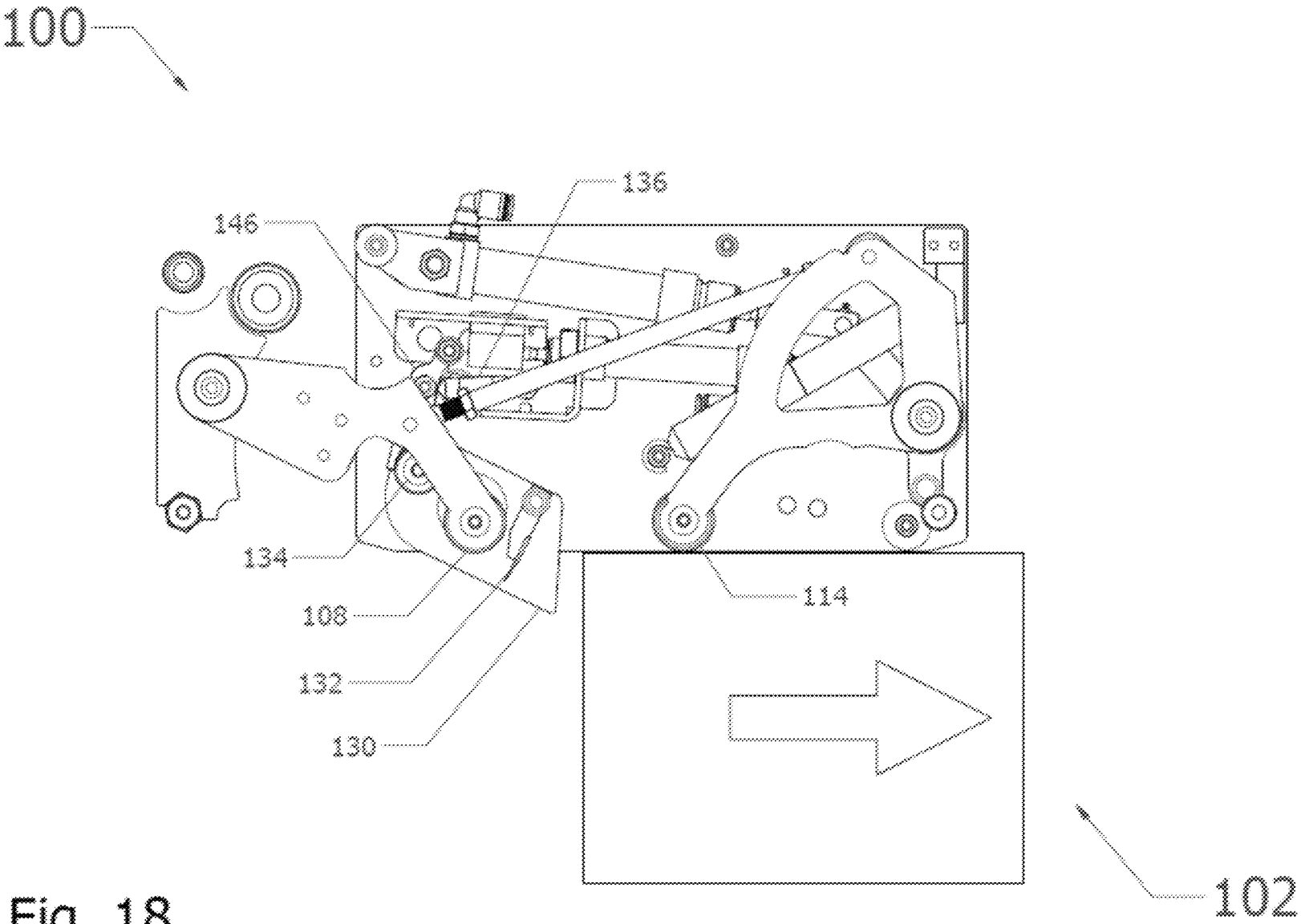

FIG. 18 shows the knife arm 130 having slid of the edge of the top surface of the case 102, and shows the knife blade 132 at or near a location from which knife will begin to make the cut. Because the knife arm 130 has slid off the top of the case, the knife arm extension 146 is rotating clockwise about the knife arm pivot 134 responsive to a force provided by the knife spring 136.

Figure 19:
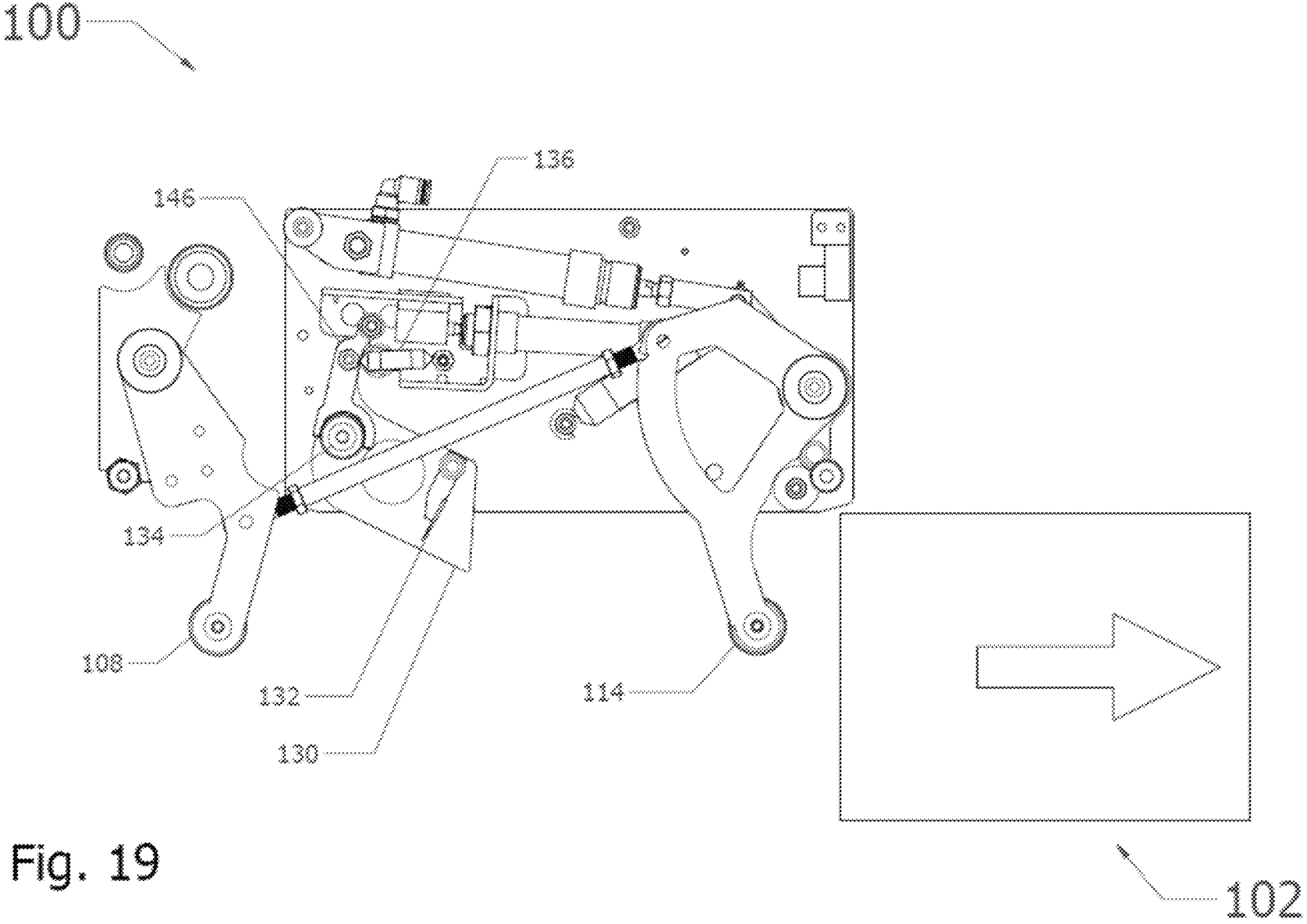

FIG. 19 shows the case having past the end of the tape head 100, and the knife arm 130, leading roller 108 and trailing roller 114 all in their lowered positions associated with the relaxed roller spring 124 and the relaxed knife spring 136.

FIGS. 20-25 show example operation of a knife assembly of the tape head with the knife-assist assembly in an engaged mode. The knife-assist assembly may include the knife-assist air cylinder 138 and knife-assist cylinder mount 148, the knife-assist cylinder air connection 140, the knife-assist push-block, and the push-block roller 144.

Figure 20:
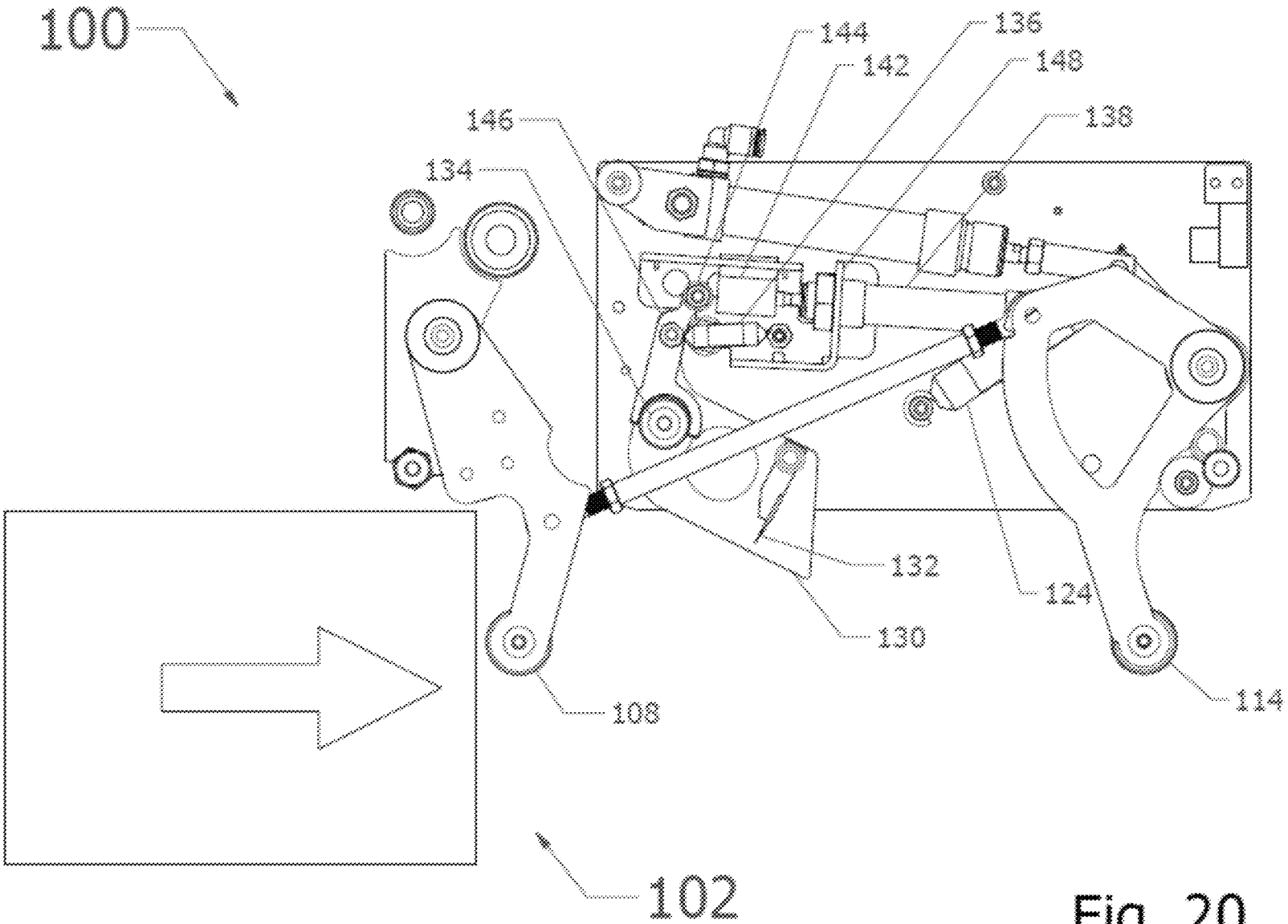
FIGS. 20-25 show example operation of a knife assembly of the tape head with the knife-assist assembly in an engaged mode.

FIG. 20 shows the case 102 making initial contact with the leading roller 108. The knife arm 130 and knife blade 132 are in the lowered position, indicating that the knife spring 136 is in the fully relaxed (e.g., not stretched) condition. The leading roller 108 and trailing roller 114 are both in the lowered position, indicating that the roller spring 124 is in the fully relaxed (e.g., not stretched) condition.

The knife-assist air cylinder 138 is in the retracted position. The knife-assist push-block 142 may be in contact with the push-block roller 144, but has not yet started to push on the push-block roller.

Figure 21:
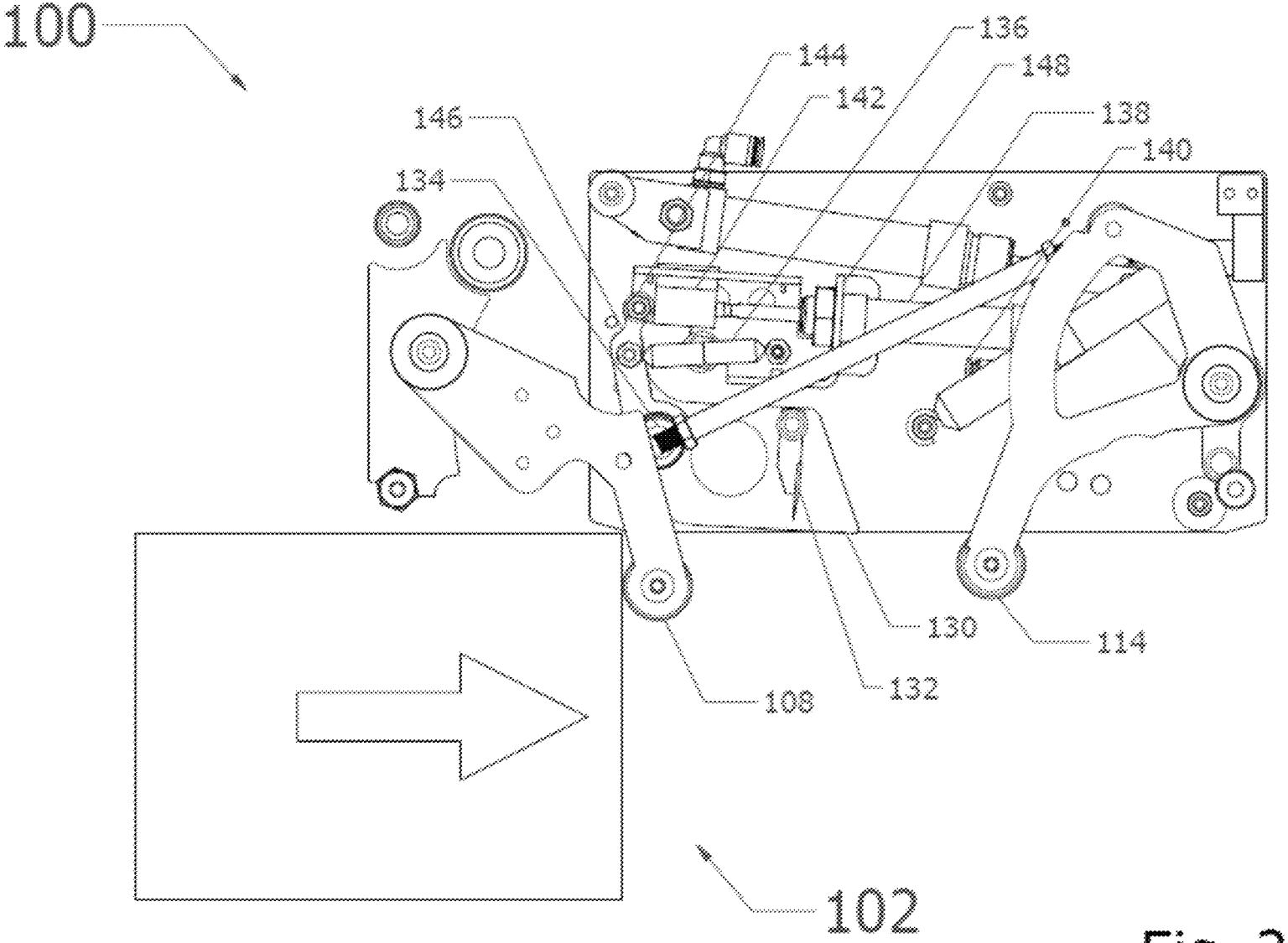

FIG. 21 shows the leading roller 108 moving up the leading side of the case 102, the knife arm 130 is now elevated above the top of the case 102 in response to extension of the knife-assist air cylinder 138. The extension of the knife-assist air cylinder 138 has caused the knife-assist push-block 142 to push the knife arm extension 146. Rotation of the knife arm extension 146 tensions (e.g., stretches) the knife spring 136. The power stored in the spring will be used to move the knife blade 132 to cut the tape at the appropriate time. Extension of the knife-assist air cylinder 138 also rotates the knife arm 130 and knife blade 132 to an elevation above the top of the case 102. Accordingly, the case 102 may move under the knife arm 130 without pushing on the knife arm, as would have been the case if the knife-assist air cylinder 138 was not operational. Thus, power from the knife-assist air cylinder 138 (totally or partially) replaces power from the case 102 moving against the knife arm 130 to stretch the knife spring 136.

Figure 22:
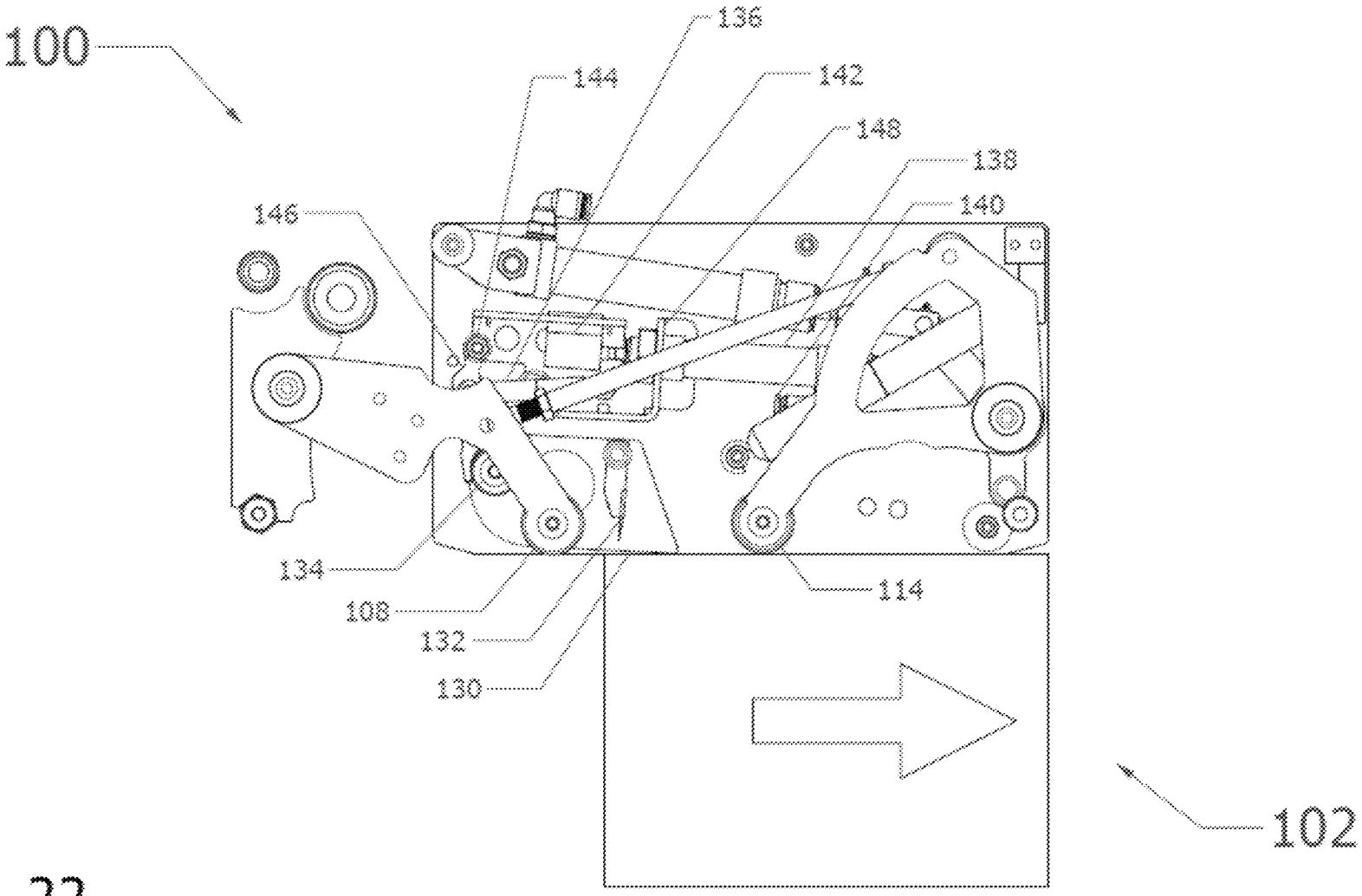

FIG. 22 shows the leading roller 108, having moved up the leading vertically-oriented side, has pressed tape onto the top two flaps of the case, and has moved off the end of the case. The trailing roller 114 is moving along the top of the case, thereby repeating the path of the leading roller 108, and is pressing the tape onto the two flaps of the top of the case 102. The knife-assist cylinder 138 has retracted and the knife arm 130 is now sliding on the top of the case, and the knife blade 132 (attached to the knife arm) is moving toward a position from which it will be released to cut the tape. Because the knife-assist air cylinder 138 has been retracted, when the knife arm 130 is released to pivot about the knife arm pivot 134 under power provided by the knife spring 136, the knife-assist air cylinder does not resist the movement of the knife. In an example, when air pressure is turned off, a spring internal to the knife-assist air cylinder 138 causes the air to be flushed out of the cylinder and for the cylinder to retract.

Figure 23:
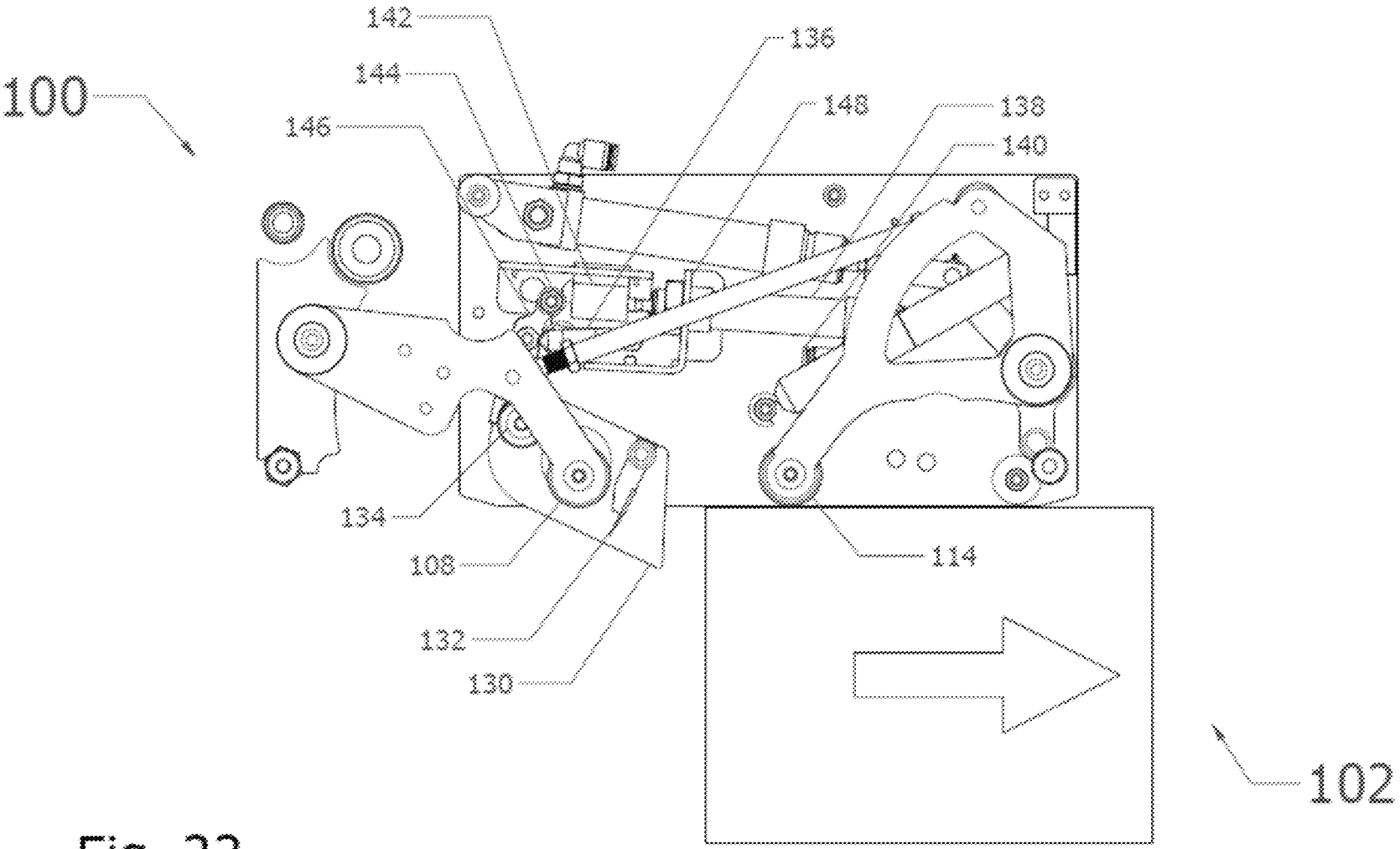

FIG. 23 shows the trailing roller 114 moving along the top of the case, and shows the knife arm 130 having slipped of the top of the moving case 102. At this point, the knife arm 130 and knife blade 132, powered the knife spring 136, begin to rotate about the knife arm pivot 134 and cut the tape (the tape not shown for clarity). The cut is made so that a prescribed length of tape (which may vary as a function of the size of the case) is available to be pressed against the trailing vertically-oriented sidewall of the case.

Figure 24:
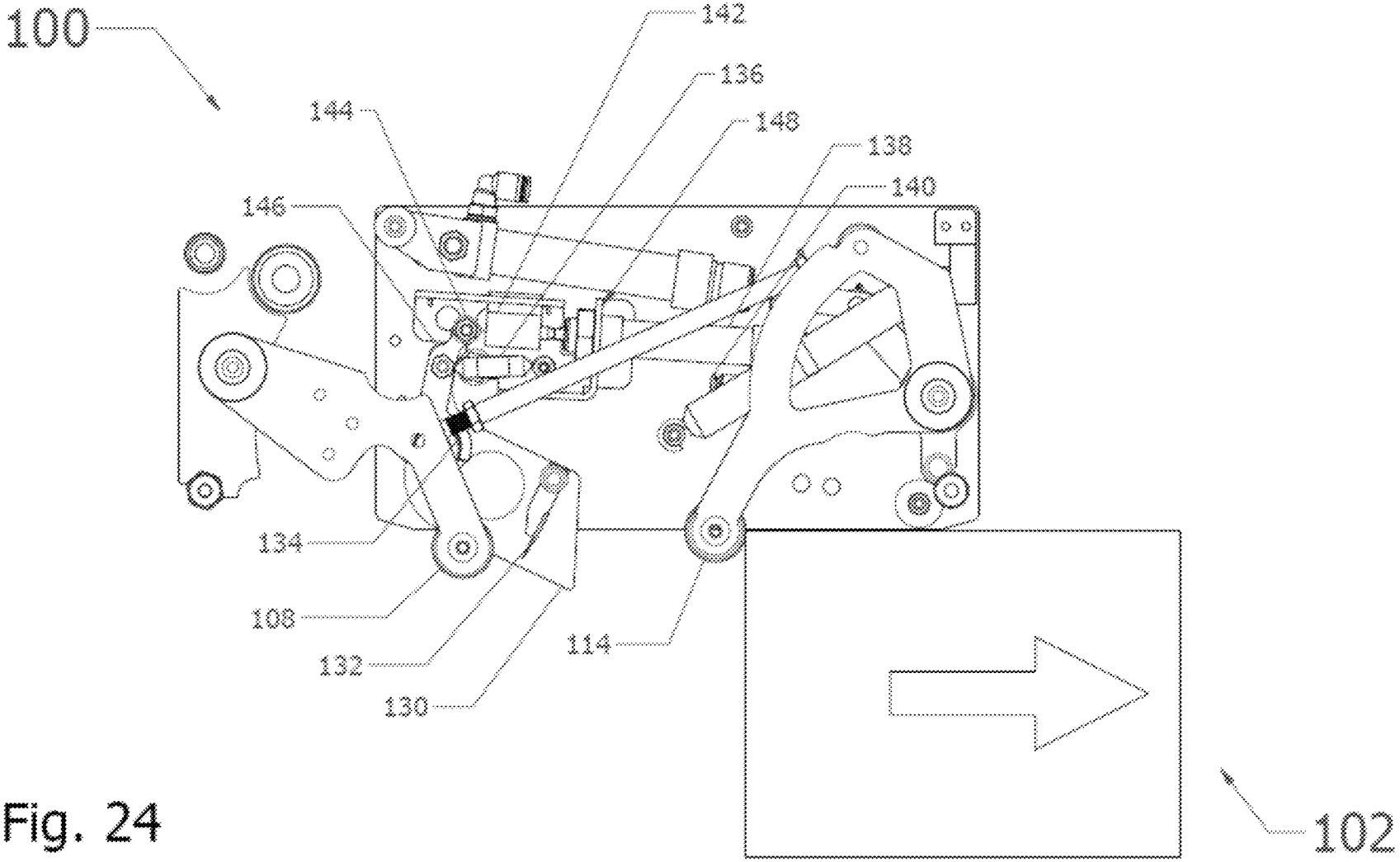

FIG. 24 shows the trailing roller 114 turning the corner to transition from pressing tape onto the top of the case 102 to pressing the cut end-portion of the tape onto the trailing side of the case.

Figure 25:
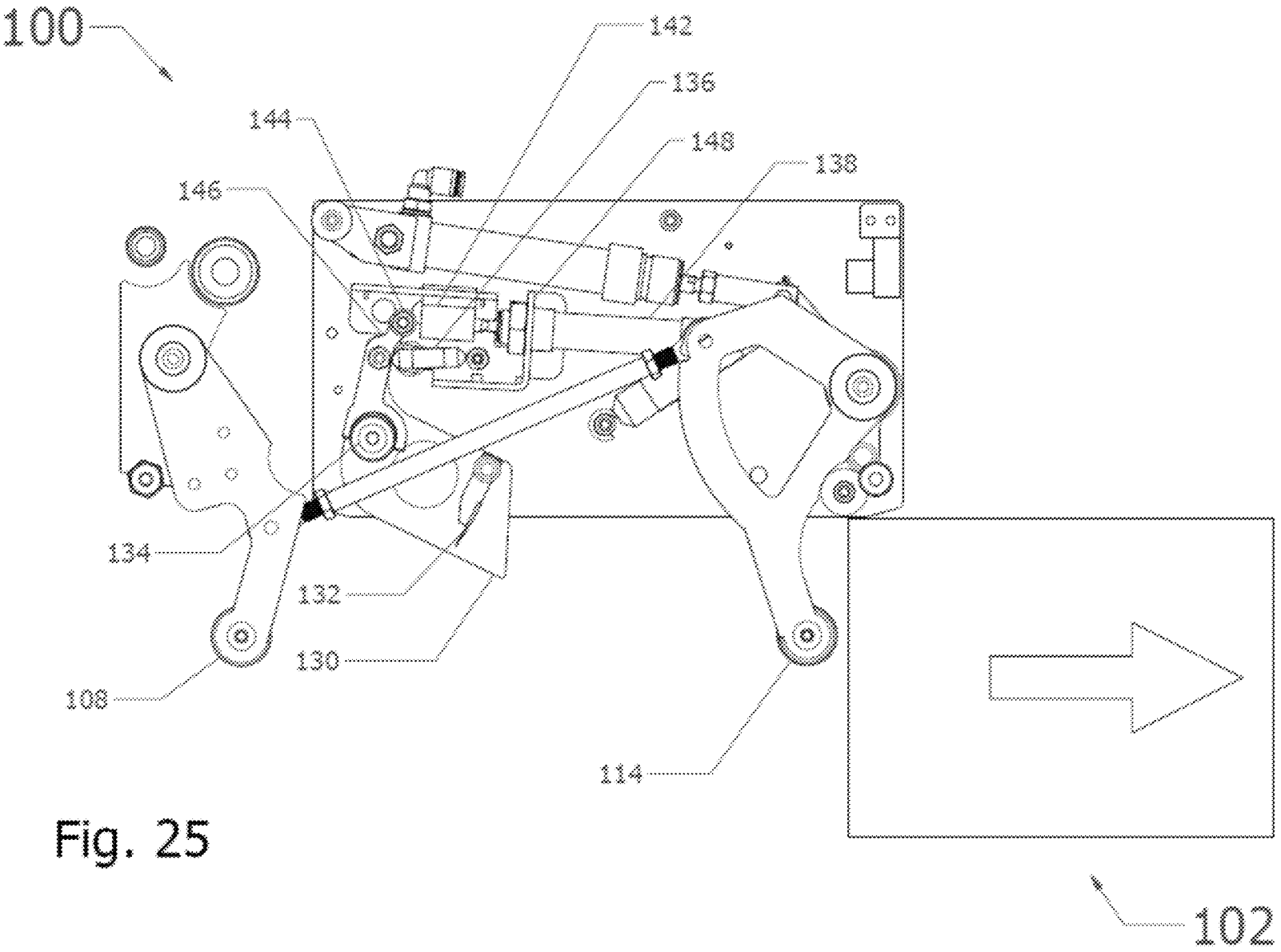

FIG. 25 shows the case 102 moving away from the trailing roller 114 of the tape head 100. At this point, the trailing roller 114 has finished pressing the cut end-portion of the tape onto the trailing side of the case.

Figure 26:
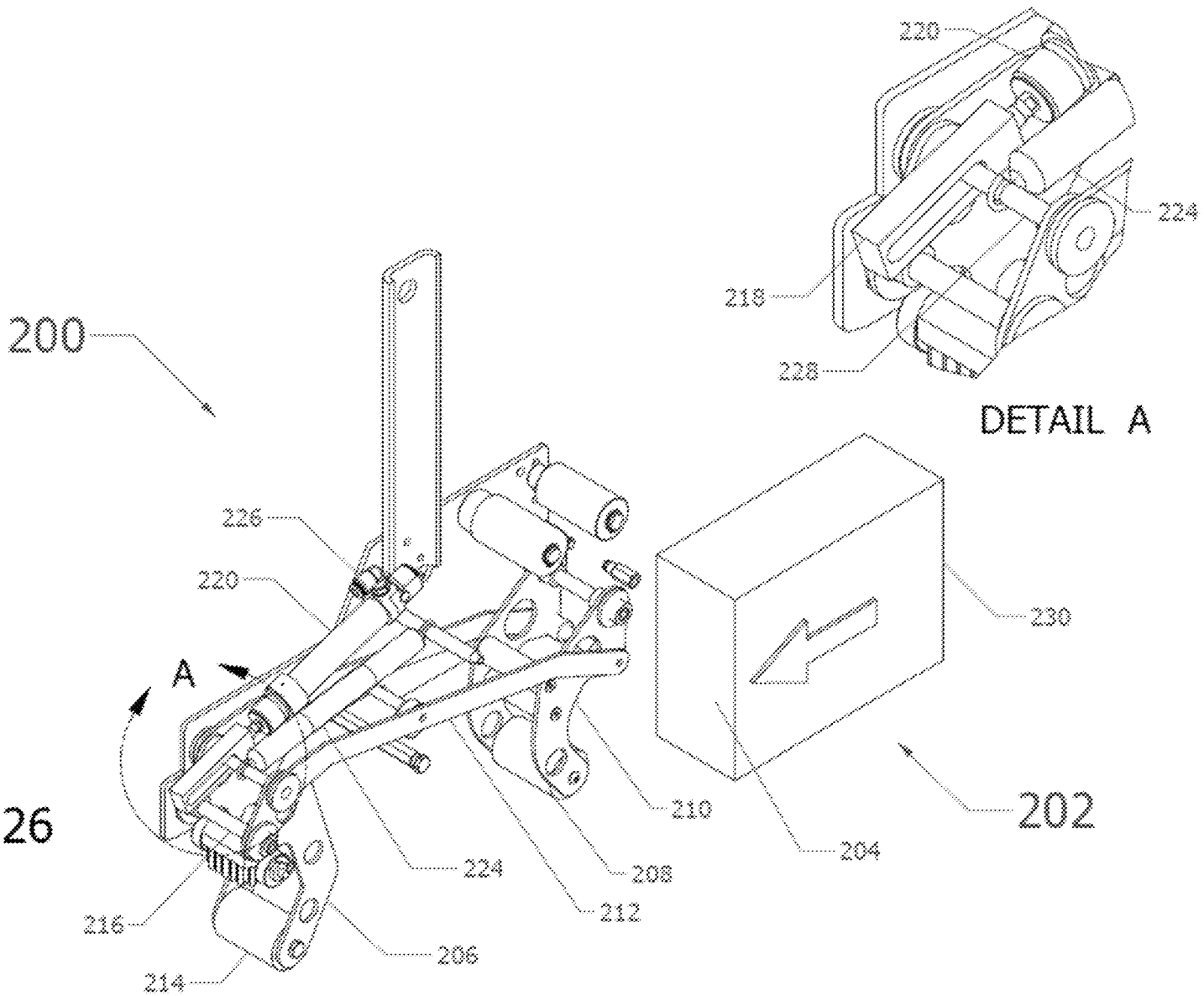
FIG. 26 is a perspective view showing example roller-assist assembly with the knife assembly and tape-cutting assembly (e.g., a knife-assist assembly) removed for clarity.

FIG. 26 shows a further example tape head 200 with a roller assembly and a roller-assist assembly. In the view, the knife assembly and knife-assist assembly removed for clarity. A case 202 (e.g., propelled by a conveyor system) is moving toward the tape head 200, where a leading vertically-oriented sidewall 204 of the case will contact the leading roller 208. The leading roller 208 is associated with a leading roller arm 210. A trailing roller 214 has an associated trailing roller arm 206. A linkage 212 connects the leading roller arm 210 to the trailing roller arm 206. The trailing roller arm 206 pivots about an arm pivot shaft 216.

A roller spring 224 is tensioned or stretched as the case 202 moves through the tape head 200 and the leading roller 208 presses tape against the leading vertically-oriented side 204 of the case 202. The spring extension shaft 228 is connected to one end of the roller spring 224 (the other end being fixed in location). The spring extension shaft 228 is connected to the trailing roller arm 206, and via the linkage 212, connected to the leading roller arm 210 and leading roller 208. Accordingly, contact by the leading vertically-oriented sidewall 204 of the incoming case 202 with the leading roller 208 moves the spring extension shaft 228 and stretches the roller spring 224. The roller spring 224 releases stored power as the case 202 passes the trailing roller 214. The power is used to press the trailing roller 214 against tape, and to thereby attach the tape to a trailing vertically-oriented sidewall 230 of the case 202.

A roller-assist air cylinder 220 is configured to assist the motion of the leading roller in stretching or otherwise tensioning the roller spring 224. In an example, the roller-assist air cylinder 220 is powered by compressed air, which may be introduced at roller-assist cylinder air connection 226. In an alternative, the roller-assist air cylinder 220 (or any other air cylinder described herein) may be replaced by a solenoid or other device suitable for tensioning the roller spring 224. Extension of the roller-assist air cylinder 220 extends roller-assist arm linkage 218, thereby advancing the spring extension shaft 228 and stretching the roller spring 224.

FIGS. 27-30 show example operation of the tape head 200 with the roller-assist in a disengaged mode. In an example, a control system may disengage the roller-assist machinery by turning off compressed air to the roller-assist air cylinder 220.

Figure 27:
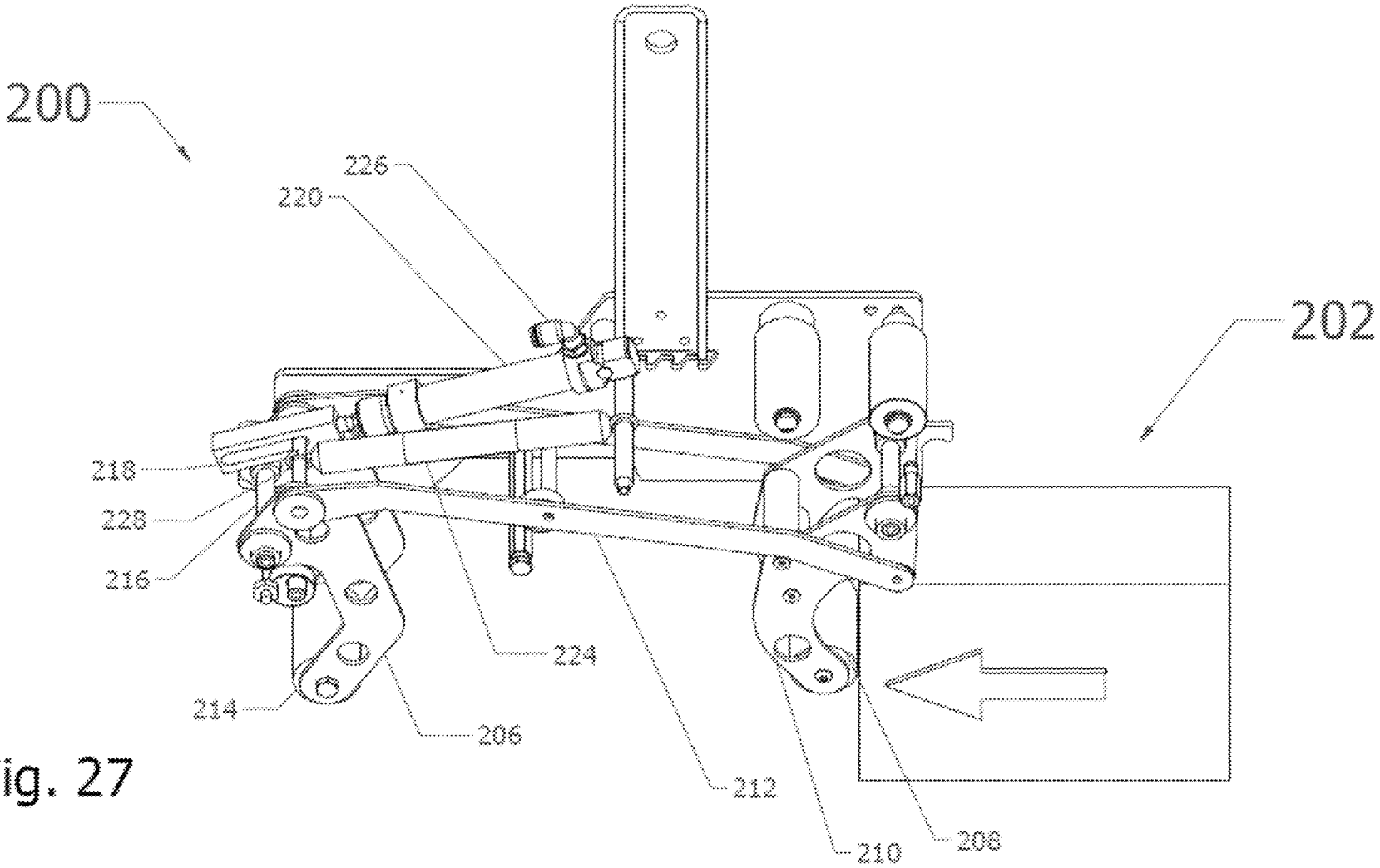
FIGS. 27-30 show example operation of the tape head with the roller-assist in a disengaged mode, e.g., with the roller-assist air cylinder held in the retracted position.

FIG. 27 shows a case 202 entering the area of a tape head 200. A leading vertically-oriented sidewall of the case 202 has contacted a leading roller 208. The leading roller 208 and the trailing roller 214 are in the lowered position.

Figure 28:
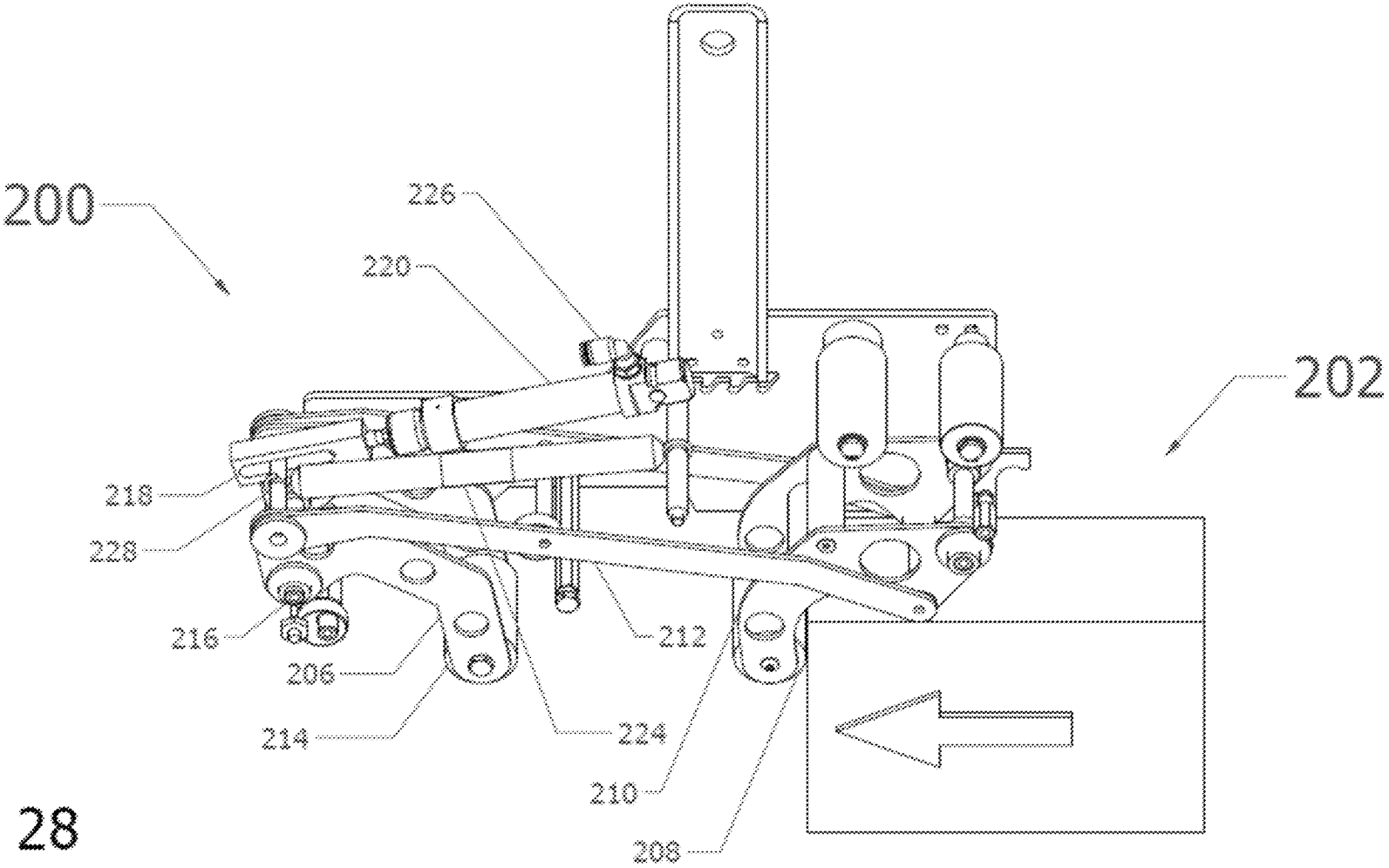

FIG. 28 shows that pressure on the leading roller 208 is rotating the leading roller arm 210. As the case 202 moves, the leading roller 208 moves upwardly and in the direction of movement of the case, and presses tape (not shown) against the leading vertically-oriented sidewall of the case. Movement of the leading roller arm 210 moves the arm linkage 212, causing the trailing roller arm 206 to rotate about the arm pivot shaft 216. Rotation of the trailing roller arm 206 causes the spring extension shaft 228 to extend the roller spring 224.

Figure 29:
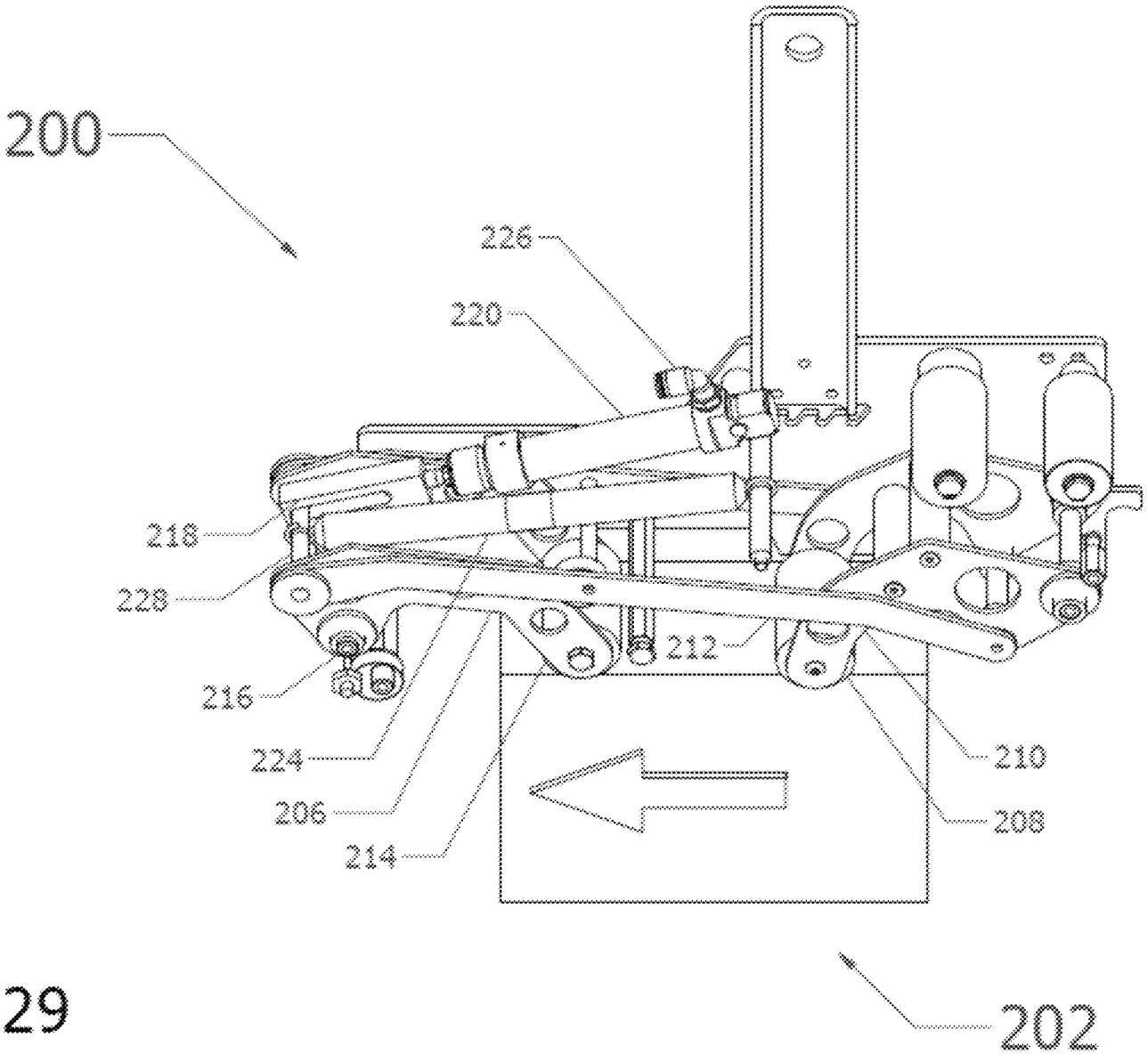

FIG. 29 shows the leading roller 208 and the trailing roller 214 in the fully elevated position, and the roller spring 224 in the fully extended position. The roller-assist air cylinder 220 is not in operation; however, the spring extension shaft 228 has travelled to an end of the slot of the roller-assist arm linkage 218 indicating that the spring is fully stretched.

Figure 30:
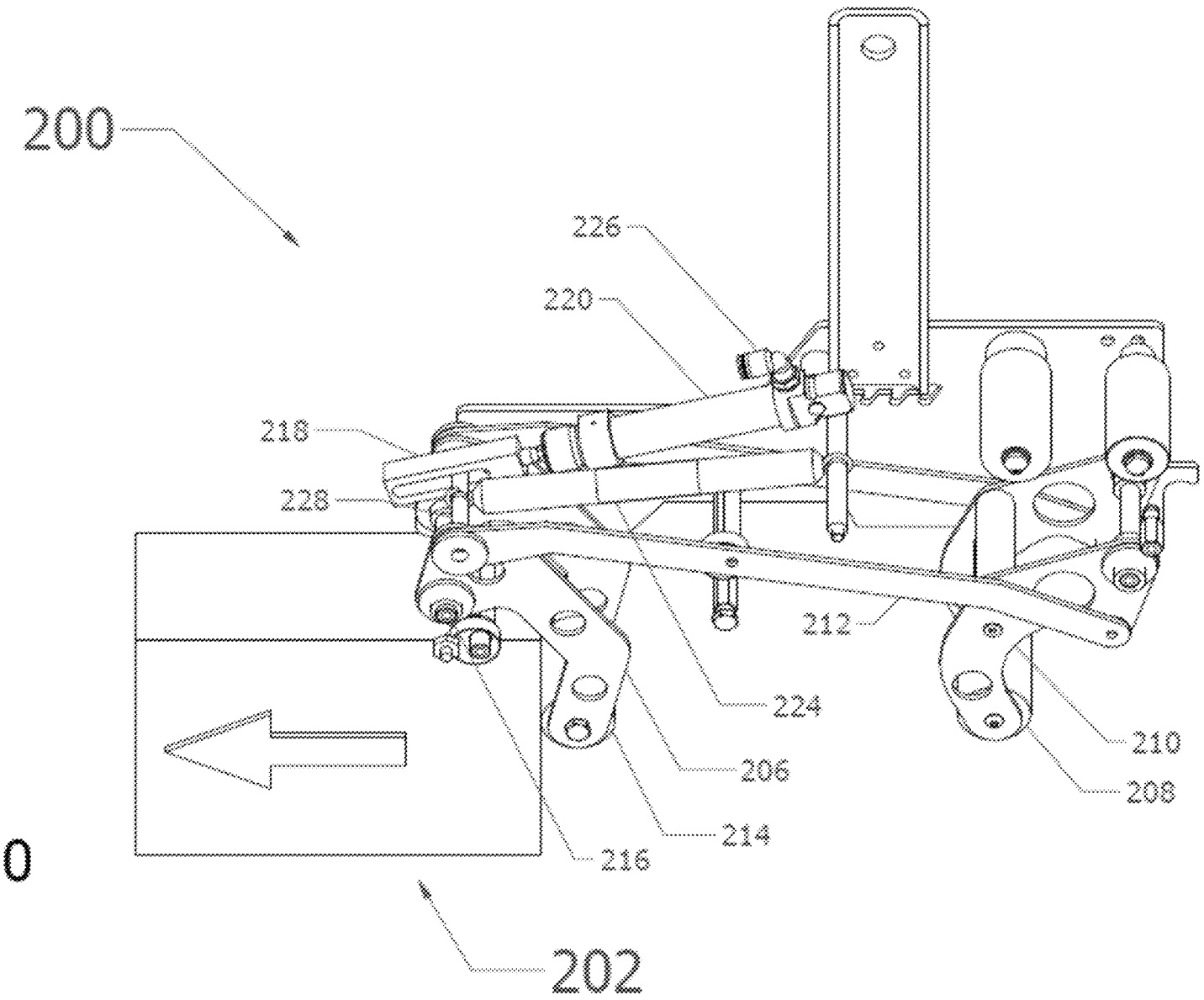

FIG. 30 shows the trailing roller 214 has moved off the upper surface of the case 202, is moving under the power of the roller spring 224, and is pressing tape against the trailing vertically-oriented sidewall of the case 202. With the roller-assist functionality turned off, as the trailing roller 214 presses tape to the sidewall, the trailing roller arm 206 pivots about the arm pivot shaft 216 and the spring extension shaft 228 slides within the slot of the retracted roller-assist arm linkage 218.

FIGS. 31-34 show example operation of the tape head with the roller-assist in an engaged mode. In the engaged mode, a significant amount of the power stored in the roller spring 224 is derived from the roller-assist air cylinder 220. Accordingly, the leading roller 208 may be moved by the case 202 with significantly less resistance (than in a disengaged mode). The amount of force required to move the leading roller 208 may be selected by adjusting a pressure of the compressed air provided to the roller-assist air cylinder 220. The adjustment may be based at least in part by a desired force with which the leading roller 208 resists the movement of the case, and thereby how forcefully the tape is pressed against the leading vertically-oriented sidewall of the case.

Figure 31:
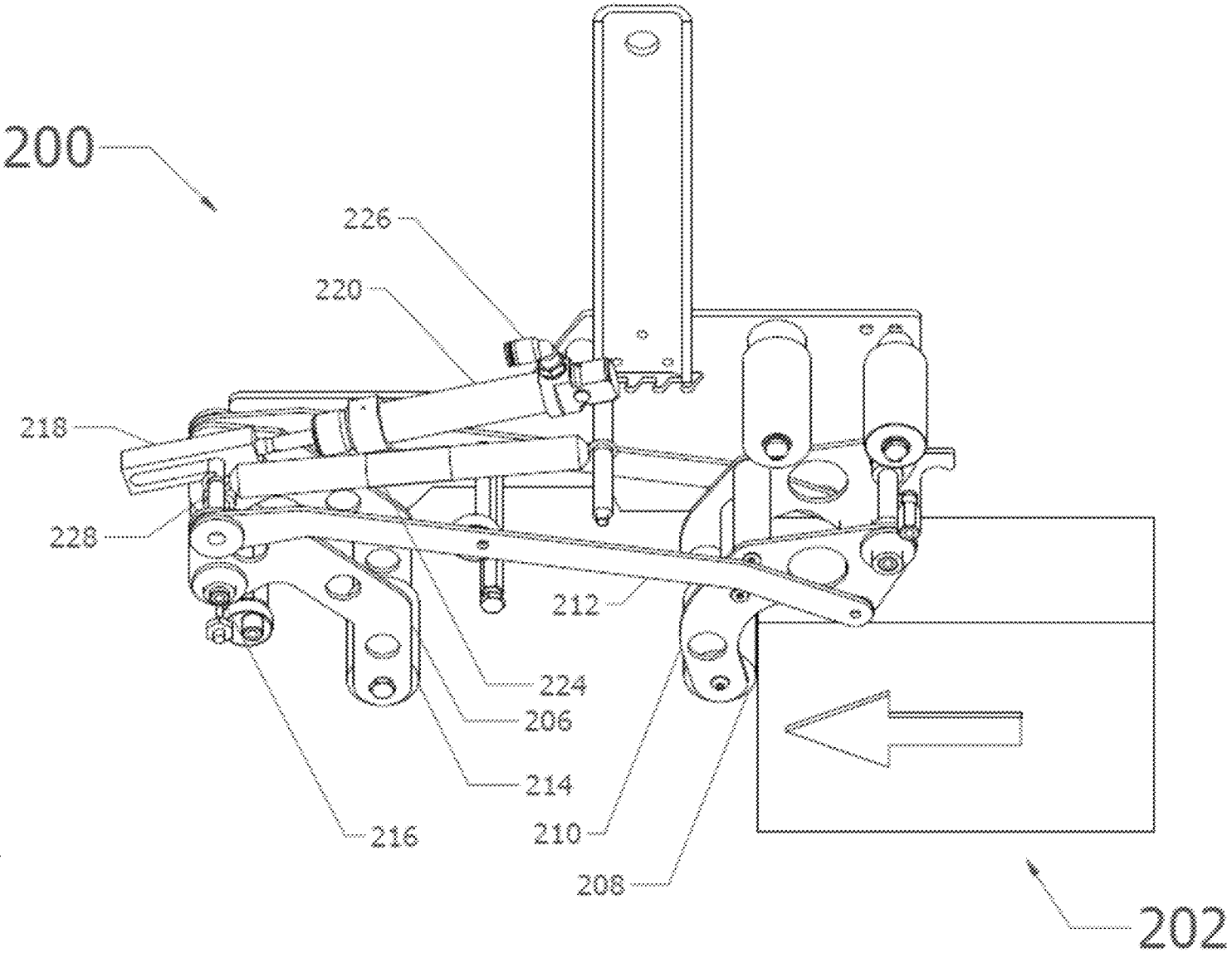
FIGS. 31-34 show example operation of the tape head with the roller-assist in an engaged mode.

FIG. 31 shows a case 202 approaching a tape head 200. The leading roller 208 and the trailing roller 214 are both in the lowered position. The case has contacted a leading roller 208 that is supported by leading roller arm 210. An arm linkage 212 connects the leading roller arm 210 to a trailing roller arm 206 supporting the trailing roller 214. The roller spring 224 is supported by a movable spring extension shaft 228. The availability of compressed air through roller-assist cylinder air connection 226 has extended the roller-assist air cylinder 220. The extension of the cylinder extends a roller-assist arm linkage 218. In the state or condition shown, the roller-assist arm linkage 218 is fully extended, causing the spring extension shaft 228 to pivot about the arm pivot shaft 216, thereby assisting the extension of (i.e., tensioning) the roller spring 224. Extension of the roller-assist air cylinder 220 makes it much easier for the moving case 202 to move the leading roller 208 (and thereby stretch the roller spring 224) than without the assistance of the roller-assist air cylinder 220.

Figure 32:
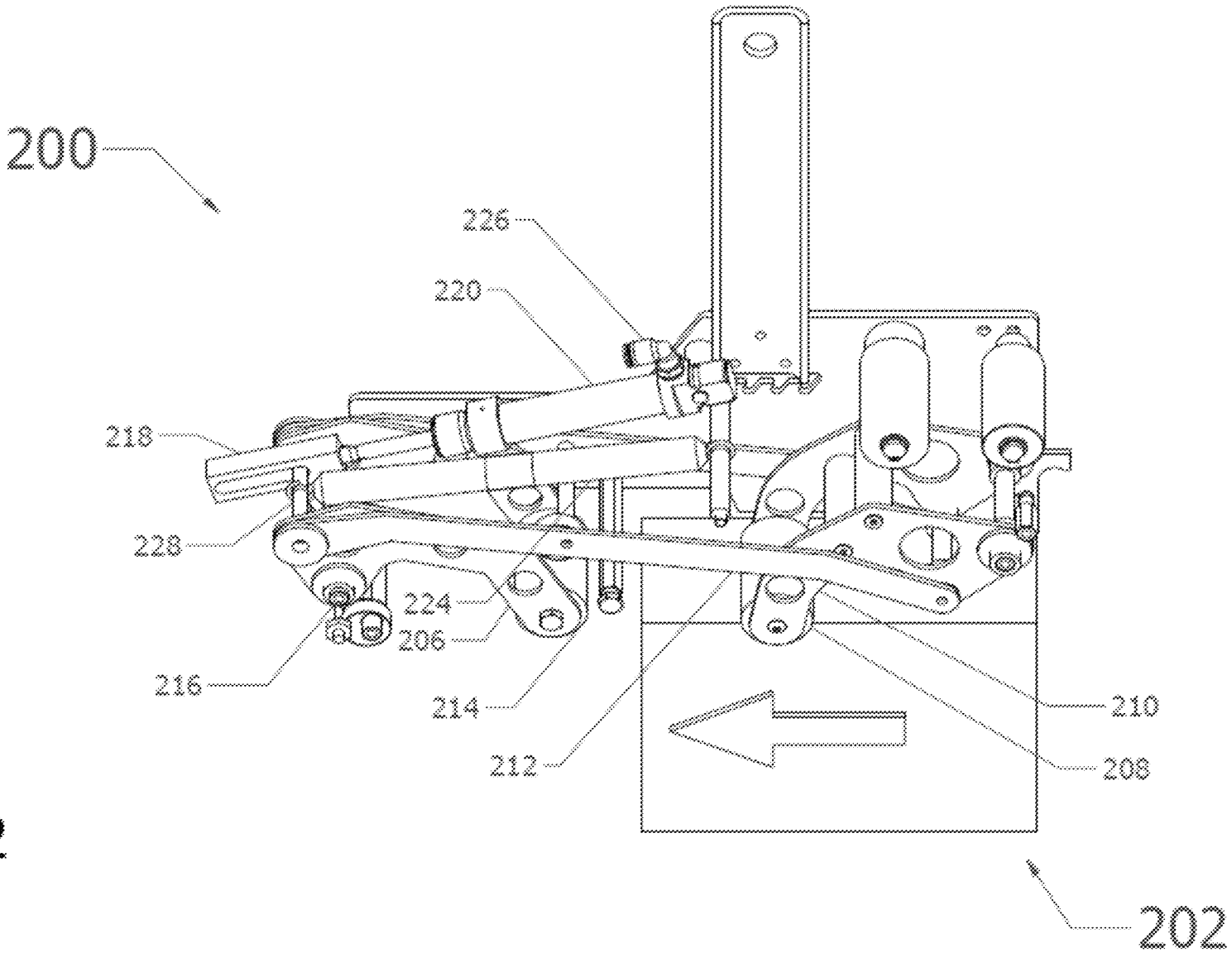

FIG. 32 shows the leading roller 208 pressing tape (not shown) against the top flaps of the case 202. Compressed air continues to be applied to the roller-assist cylinder air connection 226, and the roller-assist arm linkage 218 is still extended by the roller-assist air cylinder 220. The roller spring 224 is fully stretched.

Figure 33:
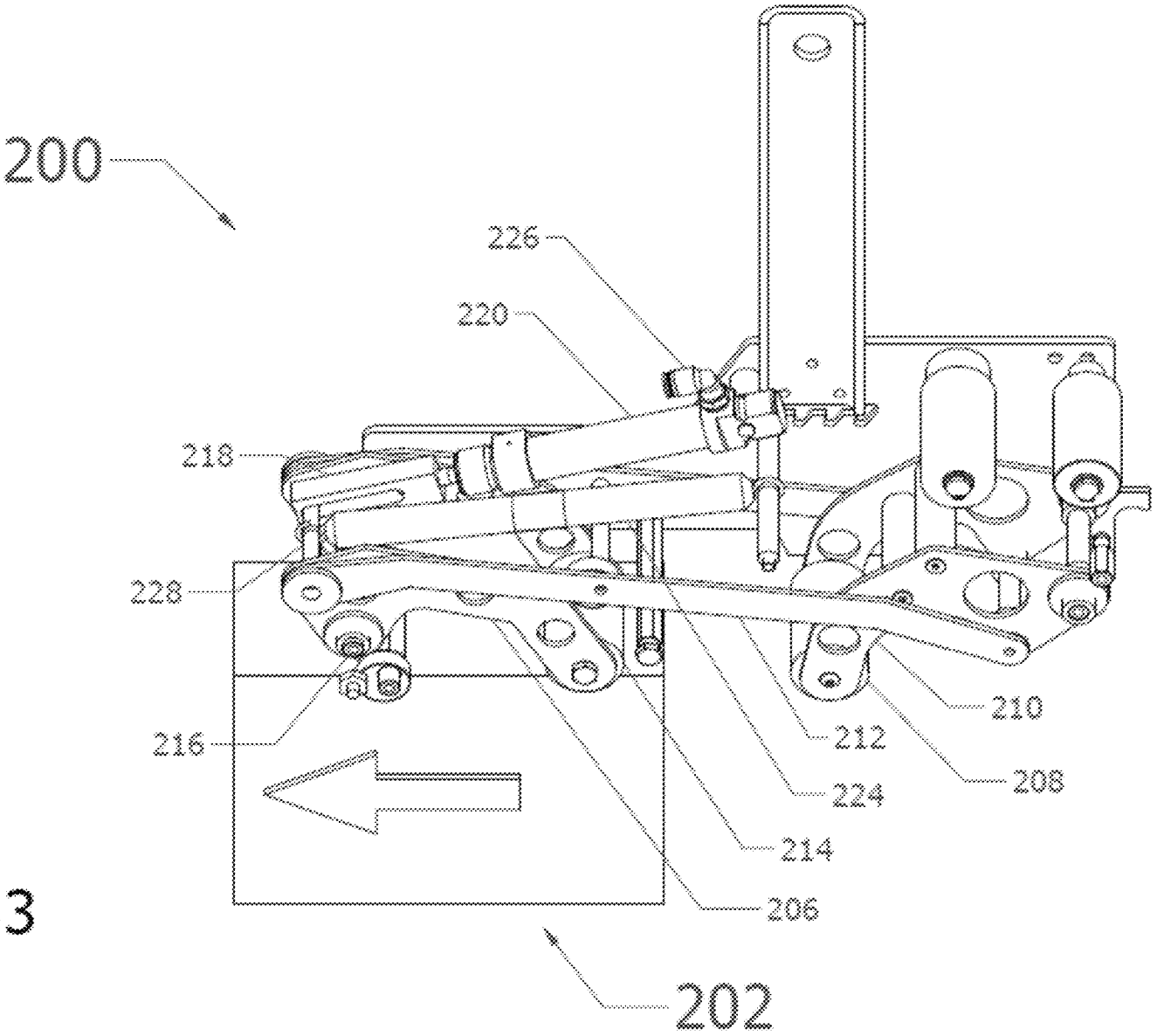

FIG. 33 shows the case 202 moving beneath the tape head 200, with the leading roller 208 and trailing roller 214 in the elevated position. In the view shown, the trailing roller 214 pressing tape (not shown) onto the two flaps of the top surface of the case 202. Air pressure has been removed to the roller-assist cylinder air connection 226, and the roller-assist air cylinder 220 has retracted. Accordingly, there is space in the slot of the roller-assist arm linkage 218 for the spring extension shaft 228 to move freely, when the roller spring 228 is allowed to relax (e.g., contract). Contraction of the roller spring 228 will cause the trailing roller 214 to press tape against the trailing vertically-oriented sidewall of the case 202 when the case moves out from under the trailing roller.

Figure 34:
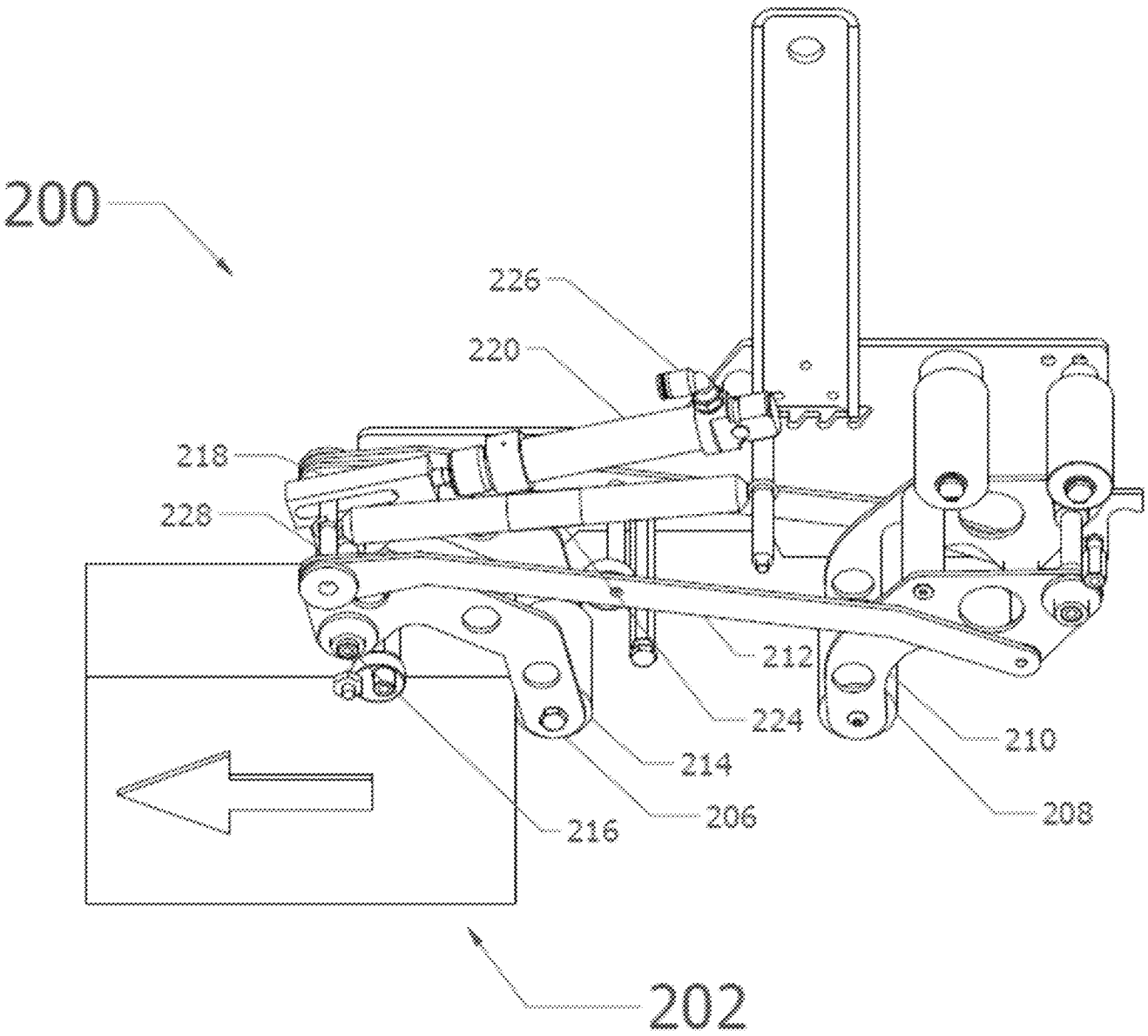

FIG. 34 shows the trailing roller 214 beginning to press tape (not shown for clarity) against the trailing vertically-oriented sidewall of the case 102. The trailing roller 214 is moving in response to rotation of the trailing roller arm 206 about arm pivot shaft 216. The energy to move the trailing roller arm 206 is supplied by contraction of the roller spring 224, which pulls on the spring extension shaft 228, thereby causing the trailing roller arm 206 to rotate about the arm pivot shaft 216. The spring extension shaft 228 is moving within the slot in the roller-assist arm linkage 218 as it rotates about the arm pivot shaft 216.

Example Methods

Figure 35:
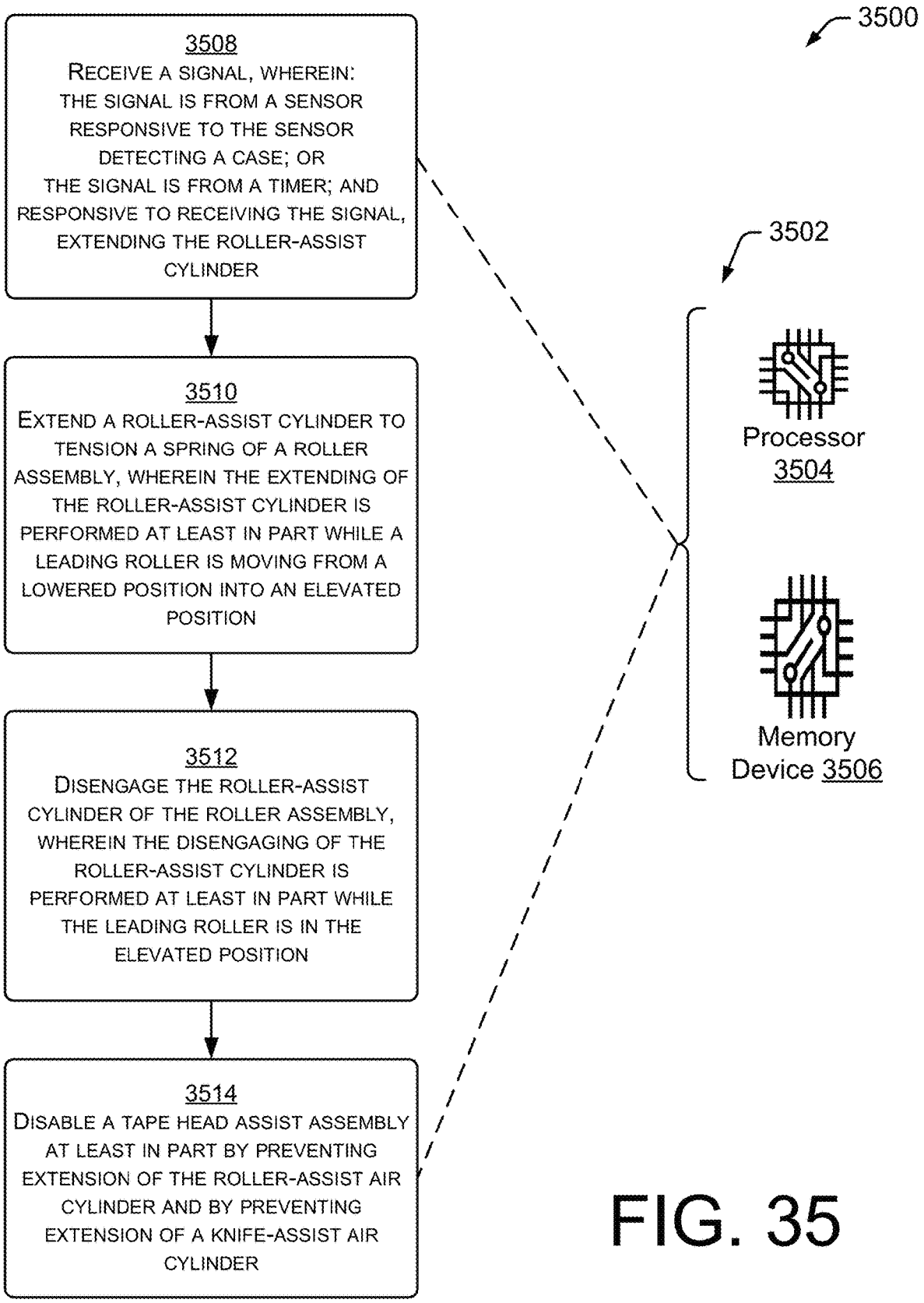
FIG. 35 is a flowchart showing an example method by which a roller-assist assembly may be operated.
Figure 36:
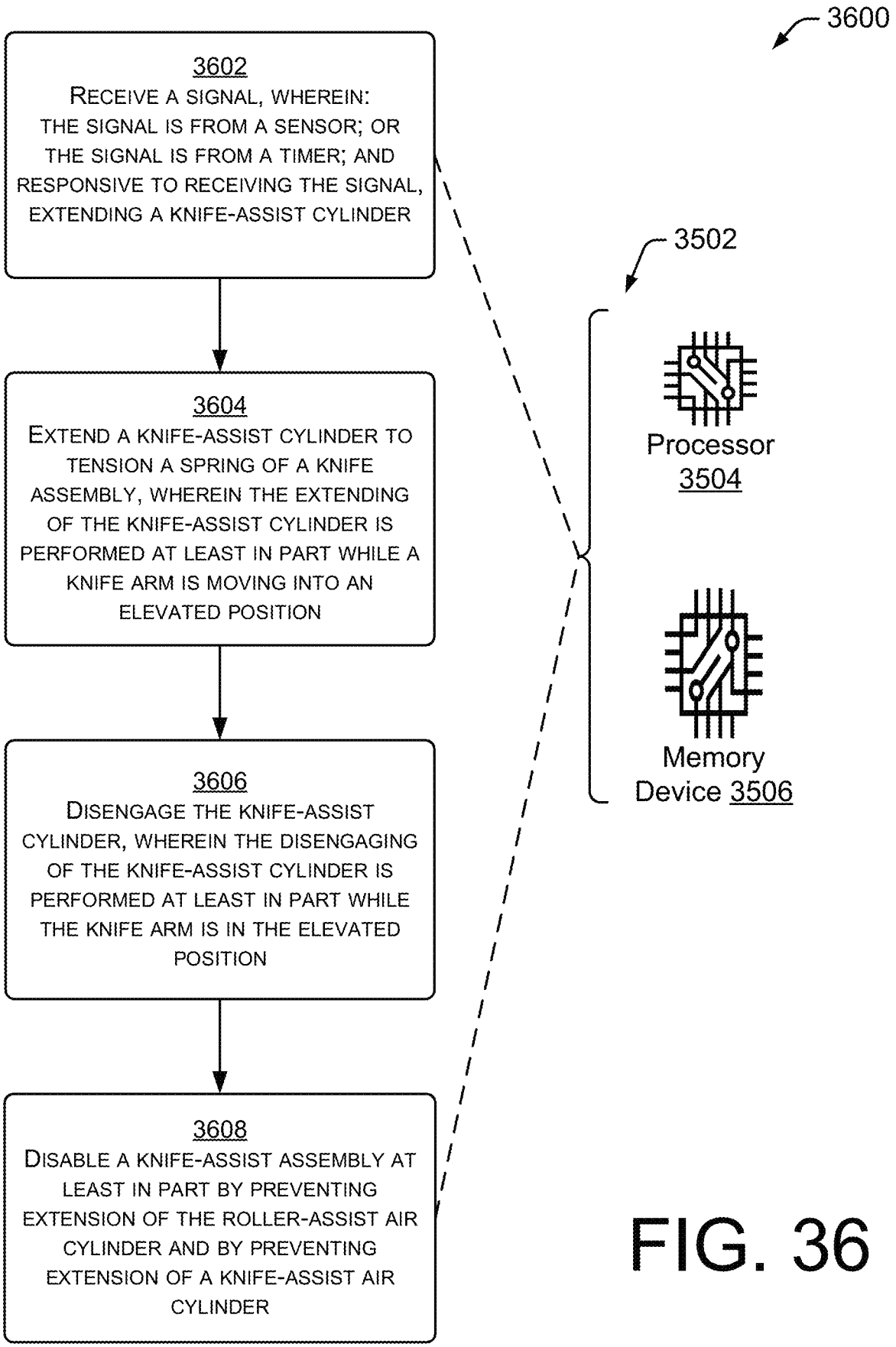
FIG. 36 is a flowchart showing an example method by which a knife-assist and/or tape-cutting assembly may be operated.

FIGS. 35 and 36 are a flowcharts showing example methods and operation of a tape head, tape head assist assembly, and/or tape head control assembly, configured to seal cases, assist in the operation of a tape head, and/or control the operation of a tape head assist assembly. The methods and operation may be performed and/or directed by any desired integrated circuit, logic devices, programming, etc. The example methods of FIGS. 35 and 36 may be implemented at least in part using the techniques of FIGS. 1-34. However, the methods of FIGS. 35 and 36 contain general applicability, and are not limited by other drawing figures and/or prior discussion. The functional blocks of FIGS. 35 and 36 may be implemented by software and/or hardware structures or devices that are configured to operate a tape head assist assembly or device. In one example, one or more functional blocks may be implemented by a microprocessor, a ladder logic device, a microcontroller or other logic device, etc., one or more memory devices, a general purpose processor and computer-readable media, application specific integrated circuits, software blocks, subroutines, programs, etc. Computer-readable media, as the term is used herein, includes, at least, two types of computer-readable media, namely computer storage media and communications media. Computer storage media includes volatile and non-volatile, removable and non-removable media implemented in any method or technology for storage of information such as computer readable instructions, data structures, program modules, or other data. Computer storage media includes, but is not limited to, RAM, ROM, EEPROM, flash memory or other memory technology, CD-ROM, digital versatile disks (DVD) or other optical storage, magnetic cassettes, magnetic tape, magnetic disk storage or other magnetic storage devices, or any other non-transmission medium that can be used to store information for access by a computing device. Computer storage media may be non-transitory in nature. In contrast, communication media may embody computer readable instructions, data structures, program modules, or other data in a modulated data signal, such as a carrier wave, or other transmission mechanism. As defined herein, computer storage media does not include communications media.

FIG. 35 is a flowchart showing an example method 3500 by which a roller-assist assembly may be operated. In an example, the method 3500 is performed by a control assembly 3502 for a tape head to perform the actions of the method. In the example shown, the control assembly includes a processor, controller, and/or logic device 3504 that communicates with a memory device 3506. The control assembly may also include sensors, switches, timers, valves, solenoid-operated valves, etc.

At block 3508, a signal is received (e.g., by the control assembly) to cause compressed air to be applied to the roller-assist cylinder. In a first example, the signal is from a sensor responsive to the sensor detecting a case. In a second example, the signal is from a timer, and may indicate the likely position of a case based on a sequence of events and/or input from earlier sensor signals. In an example, the signal is configured to cause and/or indicate the need for the control assembly 3502 to extend the roller-assist cylinder.

At block 3510, a roller-assist air cylinder is extended to tension a spring of a roller assembly. The extension of the cylinder may be performed responsive to the received signal. In an example, the roller-assist cylinder (e.g., cylinder 220 of FIG. 34) is extended by controlling a valve to apply compressed air to a roller-assist cylinder air connection (e.g., connection 226 of FIG. 34) of a roller-assist air cylinder. In an example, the extending of the roller-assist cylinder is performed at least in part while a leading roller is moving from a lowered position into an elevated position. By extending the cylinder during this period, a force the case must apply to the leading roller (to overcome the resistance of the roller spring to being stretched) is reduced.

At block 3512, the roller-assist cylinder of the roller assembly is disengaged (e.g., retracted). In an example, the disengaging of the roller-assist cylinder involves retracting the roller assist arm linkage (e.g., roller-assist arm linkage 218 of FIG. 34). In an example, the disengagement and/or retraction is performed at least in part while the leading roller is in the elevated position. With at least one roller (leading or trailing) in contact with the top of the case, the roller spring is unable to retract into the relaxed state, and must stay in the extended (i.e., tensioned) state. By disengaging the roller-assist cylinder, the spring will later be able to apply more power to the trailing roller than would otherwise be the case. That is, by disengaging the roller-assist cylinder, the roller-assist cylinder gets "out of the way" of movement of the roller assembly by the roller spring. In an example, when compressed air is turned off, the roller-assist cylinder retracts (i.e., disengages) on its own, due to a spring internal to the roller-assist cylinder.

At block 3514, a tape head assist assembly may be disabled to allow the tape head assembly to operate in a mode not assisted by energy and/or power from the compressed air cylinder(s). In an example, the assist assembly may be disabled at least in part by preventing extension of the roller-assist air cylinder and/or by preventing extension of a knife-assist air cylinder. These action(s) may be performed by the control assembly 3502. In the example, turning off the tape head assist assembly allows the tape head to function in a conventional manner.

FIG. 36 is a flowchart showing an example method 3600 by which a knife-assist and/or tape-cutting-assist assembly may be operated. In an example, the method 3500 is performed by the control assembly 3502, including the processor 3504 and memory 3506. In an example, the methods 3500 and 3600 may be performed in a simultaneous and/or concurrent manner to result in a tape head having both power assist to the roller assembly and power assist to the knife assembly.

At block 3602, a signal is received (e.g., by the control assembly). In an example, the signal is from a sensor or a timer. In the example and responsive to receiving the signal, the knife-assist assembly begins to operate. In the examples shown in previous figures, a valve is opened to provide air to the knife-assist air cylinder through a knife-assist cylinder air connection.

At block 3604, a knife-assist cylinder is extended to stretch (e.g., to tension) a spring of a knife assembly. In an example, the spring may be stretched prior to contact by the knife arm and the case. Thus, the knife arm does not resist movement of the case to stretch the spring, and the case moves with less resistance. Extension of the spring results in power being transferred from the knife-assist cylinder to the knife spring.

At block 3606, the knife-assist cylinder is disengaged and/or retracted. The disengagement of the knife-assist cylinder results in the air cylinder "getting out of the way" of the spring-powered knife, which is better able to function with the knife-assist cylinder retracted and/or disengaged. In an example, when compressed air is turned off, the knife-assist cylinder retracts on its own, due to an internal spring.

At block 3608, a knife-assist assembly may be disabled, allowing the knife assembly to function in a conventional manner. In an example, the knife-assist assembly may be disabled at least in part by preventing extension of the knife-assist air cylinder.

Example Systems and Devices

The following examples of a tape head assist assembly are expressed as number clauses. While the examples illustrate a number of possible configurations and techniques, they are not meant to be an exhaustive listing of the devices, systems, methods, and/or techniques described herein.

1. A tape head, comprising: a roller assembly comprising: a leading roller and a trailing roller; a linkage connecting the leading roller to the trailing roller, wherein the linkage moves the leading roller and the trailing roller in unison; a spring configured to be tensioned as the leading roller and the trailing roller are moved from a lowered position to an elevated position and configured to be relaxed as the leading roller and the trailing roller are moved from the elevated position to the lowered position; a roller-assist assembly configured to assist the roller assembly to tension the spring; and a control assembly configured to control operation of the roller-assist assembly.

2. The tape head of clause 1, additionally comprising: a knife-assist assembly configured to assist a knife assembly to tension a spring of the knife assembly; wherein the control assembly is additionally configured to control operation of the knife-assist assembly.

3. The tape head of clause 2, wherein the control assembly is configured to perform actions, comprising: extending a knife-assist cylinder to tension the spring of the knife assembly, wherein the extending of the knife-assist cylinder is performed at least in part while a knife arm is in contact with a case; and disengaging the knife-assist cylinder, wherein the disengaging of the knife-assist cylinder is performed prior to tape being cut by a knife blade. In an example, disengaging or retracting the knife-assist air cylinder may include retracting the knife-assist air cylinder, to thereby move the knife-assist push block away from the push-block roller (i.e., the push block disengages from the roller) to give the push-block roller space to move unimpeded when the spring contracts.

4. The tape head of clause 2, additionally, wherein the knife-assist assembly comprises: a knife-assist cylinder; and a knife-assist push-block, moved by the knife-assist cylinder and configured to move portions of the knife assembly.

5. The tape head of clause 1, wherein the control assembly is configured to perform actions, comprising: extending a roller-assist cylinder to move a roller-assist contact bumper to apply a force to a roller arm, wherein the extending of the roller-assist cylinder is concurrent with at least one of: a case approaching the leading roller; or the case contacting the leading roller.

6. The tape head of clause 5, wherein the control assembly is configured to perform actions, comprising: disengaging the roller-assist cylinder while the leading roller is in the elevated position. In an example, disengaging or retracting the roller-assist air cylinder may include retracting the roller-assist air cylinder, to thereby move the roller-assist arm linkage away from the spring extension shaft (i.e., the roller-assist arm linkage disengages from the extension shaft) to give the spring extension shaft space to move unimpeded when the spring contracts.

7. The tape head of clause 1, wherein the control assembly is additionally configured to perform actions, comprising: disabling the roller-assist assembly; disabling a knife-assist assembly; wherein the roller assembly and a knife assembly are configured to operate when one or more of the roller-assist assembly and the knife-assist assembly are disabled.

8. The tape head of clause 1, additionally, wherein the roller-assist assembly comprises: a roller-assist cylinder; and a roller-assist arm linkage, defining a slot within which a spring extension shaft travels, wherein the roller-assist arm linkage is configured to be moved by the roller-assist cylinder, and configured to tension the spring of the roller assembly.

9. A tape head assist assembly, comprising: a roller-assist cylinder; a roller-assist arm linkage connected to the roller-assist cylinder and configured to connect to a roller assembly; a knife-assist cylinder; and a knife-assist connector connected to the knife-assist cylinder and configured to connect to a knife assembly; and a control assembly configured to control operation of the roller-assist cylinder and the knife-assist cylinder.

10. The tape head assist assembly of clause 9, wherein the control assembly is additionally configured to perform actions, comprising: extending the roller-assist cylinder to tension a spring of the roller assembly, wherein the extending of the roller-assist cylinder is performed at least in part while a leading roller of the roller assembly is moving into an elevated position; and disengaging and/or retracting the roller-assist cylinder, wherein the disengaging of the roller-assist cylinder is performed at least in part while the leading roller is in the elevated position.

11. The tape head assist assembly of clause 9, wherein the control assembly is additionally configured to perform actions, comprising: extending the knife-assist cylinder to tension a spring of the knife assembly, wherein the extending of the knife-assist cylinder is performed at least in part while a knife arm is elevated by contact with a case; and disengaging and/or retracting the knife-assist cylinder, wherein the disengaging of the knife-assist cylinder is performed at least in part while the knife arm is sliding on a top surface of the case.

12. The tape head assist assembly of clause 9, wherein the control assembly is additionally configured to perform actions, comprising: extending the roller-assist cylinder to push a roller arm of the roller assembly while a leading roller of the roller assembly is in contact with a leading side of a case.

13. The tape head assist assembly of clause 9, wherein the control assembly is additionally configured to perform actions, comprising: disengaging and/or retracting the roller-assist cylinder while a leading roller is in an elevated position; and disengaging and/or retracting the knife-assist cylinder while a knife arm is sliding on a top surface of a case.

14. The tape head assist assembly of clause 9, wherein the control assembly is additionally configured to perform actions, comprising: disabling the tape head assist assembly by preventing extension of the roller-assist cylinder and the knife-assist cylinder.

15. The tape head assist assembly of clause 9, additionally comprising: a knife-assist push-block, moved by the knife-assist cylinder and configured to move the knife assembly.

16. A control assembly for a tape head to perform actions, comprising: extending a roller-assist cylinder to tension a spring of a roller assembly, wherein the extending of the roller-assist cylinder is performed at least in part while a leading roller is moving from a lowered position into an elevated position; and disengaging and/or retracting the roller-assist cylinder of the roller assembly, wherein the disengaging of the roller-assist cylinder is performed at least in part while the leading roller is in the elevated position.

17. The control assembly of clause 16, wherein the control assembly is additionally configured to perform actions, comprising: extending a knife-assist cylinder to tension a spring of a knife assembly, wherein the extending of the knife-assist cylinder is performed at least in part while a knife arm is moving into an elevated position; and disengaging and/or retracting the knife-assist cylinder, wherein the disengaging of the knife-assist cylinder is performed at least in part while the knife arm is in the elevated position.

18. The control assembly of clause 16, wherein the control assembly is additionally configured to perform actions, comprising: receiving a signal, wherein: the signal is from a sensor responsive to the sensor detecting a case; or the signal is from a timer; and responsive to receiving the signal, extending the roller-assist cylinder.

19. The control assembly of clause 16, wherein the control assembly is additionally configured to perform actions, comprising: receiving a signal, wherein: the signal is from a sensor; or the signal is from a timer; and responsive to receiving the signal, extending a knife-assist cylinder.

20. The control assembly of clause 16, wherein the control assembly is additionally configured to perform actions, comprising: disabling a tape head assist assembly at least in part by preventing extension of the roller-assist air cylinder and by preventing extension of a knife-assist air cylinder.

CONCLUSION

Although the subject matter has been described in language specific to structural features and/or methodological acts, it is to be understood that the subject matter defined in the appended claims is not necessarily limited to the specific features or acts described. Rather, the specific features and acts are disclosed as exemplary forms of implementing the claims.

What is claimed is:

1. A tape head, comprising:

a roller assembly comprising:

a leading roller and a trailing roller;

a linkage connecting the leading roller to the trailing roller, wherein the linkage moves the leading roller and the trailing roller in unison; and a spring configured to be tensioned as the leading roller and the trailing roller are moved from a lowered position to an elevated position and configured to be relaxed as the leading roller and the trailing roller are moved from the elevated position to the lowered position;

a roller-assist assembly configured to assist the roller assembly to tension the spring, the roller-assist assembly comprising:

a roller-assist air cylinder; and a roller-assist arm linkage connected to the roller-assist air cylinder, wherein extension of the roller-assist arm linkage tensions the spring, and wherein retraction of the roller-assist arm linkage allows the tape head to operate without operation of the roller-assist assembly; and a control assembly configured to control operation of the roller-assist air cylinder of the roller-assist assembly.

2. The tape head of claim 1, additionally comprising:

a knife-assist assembly configured to assist a knife assembly to tension a spring of the knife assembly;

wherein the control assembly is additionally configured to control operation of the knife-assist assembly.

3. The tape head of claim 2, wherein the control assembly is configured to perform actions comprising:

extending a knife-assist cylinder to tension the spring of the knife assembly, wherein the extending of the knife-assist cylinder is performed at least in part while a knife arm is in contact with a case; and disengaging the knife-assist cylinder, wherein the disengaging of the knife-assist cylinder is performed prior to tape being cut by a knife blade.

4. The tape head of claim 2, wherein the knife-assist assembly comprises:

a knife-assist cylinder; and a knife-assist push-block moved by the knife-assist cylinder and configured to move portions of the knife assembly.

5. The tape head of claim 1, wherein the control assembly is configured to perform actions comprising:

extending the roller-assist air cylinder to tension the spring, wherein the extending of the roller-assist air cylinder is concurrent with at least one of:

a case approaching the leading roller; or the case contacting the leading roller.

6. The tape head of claim 5, wherein the control assembly is configured to perform additional actions comprising:

removing compressed air fed to the roller-assist air cylinder while the leading roller is in the elevated position.

7. The tape head of claim 1, wherein the control assembly is additionally configured to perform actions comprising:

disabling the roller-assist assembly; and disabling a knife-assist assembly;

wherein the roller assembly and a knife assembly are configured to operate when one or more of the roller-assist assembly and the knife-assist assembly are disabled.

8. The tape head of claim 1, wherein the control assembly is additionally configured to perform actions comprising:

extending the roller-assist air cylinder to tension the spring of the roller assembly, wherein the extending of the roller-assist air cylinder is performed at least in part while the leading roller of the roller assembly is moving into the elevated position; and disengaging the roller-assist air cylinder, wherein the disengaging of the roller-assist air cylinder is performed at least in part while the leading roller is in the elevated position.

9. The tape head of claim 1, wherein the control assembly is additionally configured to perform actions comprising:

extending a knife-assist air cylinder to tension a spring of a knife assembly, wherein the extending of the knife-assist air cylinder is performed at least in part while a knife arm is elevated by contact with a case; and disengaging the knife-assist air cylinder, wherein the disengaging of the knife-assist air cylinder is performed at least in part while the knife arm is sliding on a top surface of the case.

10. The tape head of claim 1, wherein the control assembly is additionally configured to perform actions comprising:

extending the roller-assist air cylinder to push a roller arm of the roller assembly while the leading roller of the roller assembly is in contact with a leading side of a case.

11. The tape head of claim 1, wherein the control assembly is additionally configured to perform actions comprising:

disengaging the roller-assist air cylinder while the leading roller is in the elevated position; and disengaging a knife-assist cylinder while a knife arm is sliding on a top surface of a case.

12. The tape head of claim 1, wherein the control assembly is additionally configured to perform actions comprising:

disabling the roller-assist assembly by preventing extension of the roller-assist air cylinder; and disabling a knife-assist assembly by preventing extension of a knife-assist air cylinder.

13. The tape head of claim 1, additionally comprising:

a knife-assist push-block moved by a knife-assist air cylinder and configured to move a knife assembly.

14. The tape head of claim 1, wherein the control assembly is additionally configured to perform actions comprising:

extending a knife-assist cylinder to tension a spring of a knife assembly, wherein the extending of the knife-assist cylinder is performed at least in part while a knife arm is moving into an elevated position; and disengaging the knife-assist cylinder, wherein the disengaging of the knife-assist cylinder is performed at least in part while the knife arm is in the elevated position.

15. The tape head of claim 1, wherein the control assembly is additionally configured to perform actions comprising:

receiving a signal, wherein:

the signal is from a sensor and is sent in response to the sensor detecting a case, or the signal is from a timer; and responsive to receiving the signal, extending the roller-assist air cylinder.

16. The tape head of claim 1, wherein the control assembly is additionally configured to perform actions comprising:

receiving a signal, wherein: the signal is from a sensor or the signal is from a timer; and responsive to receiving the signal, extending a knife-assist cylinder.

* * * * *